US009876288B2

(12) United States Patent
Youtsey

(10) Patent No.: US 9,876,288 B2
(45) **Date of Patent: *Jan. 23, 2018**

(54) COAXIAL CABLE CONNECTOR WITH COMPRESSION BANDS

(71) Applicant: PCT International, Inc., Mesa, AZ (US)

(72) Inventor: Timothy L. Youtsey, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/160,862

(22) Filed: May 20, 2016

(65) Prior Publication Data

US 2016/0268708 A1 Sep. 15, 2016

Related U.S. Application Data

(63) Continuation of application No. 14/275,219, filed on May 12, 2014, now Pat. No. 9,373,902, which is a continuation of application No. 13/739,972, filed on Jan. 11, 2013, now Pat. No. 9,039,446.

(60) Provisional application No. 61/658,087, filed on Jun. 11, 2012.

(51) Int. Cl.
*H01R 9/05* (2006.01)

(52) U.S. Cl.
CPC ..... *H01R 9/0524* (2013.01)

(58) Field of Classification Search
CPC .... H01R 9/0521; H01R 2103/00; H01R 9/05; H01R 9/0524; H01R 24/564
USPC ..... 439/584
See application file for complete search history.

(56) References Cited

U.S. PATENT DOCUMENTS

| | | | | |
|---|---|---|---|---|
| 3,199,061 | A | 8/1965 | Johnson et al. | |
| 4,377,320 | A | 3/1983 | Lanthrop et al. | |
| 4,990,106 | A | 2/1991 | Szegda | |
| 5,466,173 | A | 11/1995 | Down | |
| 5,498,175 | A | 3/1996 | Yeh et al. | |
| 5,501,616 | A | 3/1996 | Holliday | |
| 5,879,191 | A * | 3/1999 | Burris | H01R 9/0521 439/271 |
| 5,975,951 | A * | 11/1999 | Burris | H01R 13/5202 439/322 |
| 5,993,254 | A * | 11/1999 | Pitschi | H01R 9/0521 439/584 |
| 5,997,350 | A * | 12/1999 | Burris | H01R 9/0521 285/249 |
| 6,010,289 | A | 1/2000 | Distasio et al. | |
| 6,042,422 | A * | 3/2000 | Youtsey | H01R 9/0518 439/585 |
| 6,153,830 | A * | 11/2000 | Montena | H01R 9/0521 174/88 C |
| 6,425,782 | B1 * | 7/2002 | Holland | H01R 9/0521 439/578 |
| 6,648,683 | B2 | 11/2003 | Youtesy | |
| 6,712,631 | B1 | 3/2004 | Youtsey | |
| 6,767,248 | B1 * | 7/2004 | Hung | H01R 13/5205 439/578 |

(Continued)

*Primary Examiner* — Abdullah Riyami
*Assistant Examiner* — Vladimir Imas
(74) *Attorney, Agent, or Firm* — Thomas W. Galvani, P.C.; Thomas W. Galvani

(57) ABSTRACT

A cable connector for coupling to a coaxial cable includes an outer barrel configured to receive the cable, a collar received on the outer barrel, and a seal assembly. The seal assembly includes a plurality of compressible compression bands, the seal assembly configured to provide a seal with a cable received by the cable connector.

21 Claims, 12 Drawing Sheets

(56) References Cited

U.S. PATENT DOCUMENTS 6,848,939 B2 * 2/2005 Stirling ..... H01R 9/0521 439/578
7,018,235 B1 * 3/2006 Burris ..... H01R 9/0518 439/578
7,021,965 B1 * 4/2006 Montena ..... H01R 9/0518 439/578
7,063,565 B2 * 6/2006 Ward ..... H01R 13/506 439/578
7,125,283 B1 * 10/2006 Lin ..... H01R 9/0518 439/578
7,128,603 B2 * 10/2006 Burris ..... H01R 9/0521 439/578
7,144,272 B1 12/2006 Burris et al.
7,182,639 B2 * 2/2007 Burris ..... H01R 9/0518 439/578
7,252,546 B1 * 8/2007 Holland ..... H01R 9/0524 439/584
7,288,002 B2 * 10/2007 Rodrigues ..... H01R 13/5816 439/439
7,354,307 B2 * 4/2008 Chee ..... H01R 9/0527 439/272
7,364,462 B2 * 4/2008 Holland ..... H01R 9/0527 439/578
7,377,809 B2 5/2008 Dyck
7,404,373 B2 7/2008 Youtsey
7,458,851 B2 * 12/2008 Montena ..... H01R 9/0521 439/584
7,510,432 B2 3/2009 Entsfellner
7,527,524 B1 5/2009 Coleman et al.
7,568,944 B1 * 8/2009 Linan ..... H01R 9/0521 439/578
7,753,727 B1 7/2010 Islam et al.
7,845,978 B1 * 12/2010 Chen ..... H01R 9/0521 439/578
7,934,953 B1 5/2011 Solis
7,976,339 B2 7/2011 Buck et al.
8,029,316 B2 10/2011 Snyder et al.
8,075,339 B2 * 12/2011 Holliday ..... H01R 9/0518 439/584
8,137,132 B2 * 3/2012 Lu ..... H01R 9/0524 439/578
8,167,635 B1 * 5/2012 Mathews ..... H01R 13/5205 439/277
8,272,893 B2 * 9/2012 Burris ..... H01R 9/0524 439/578
8,348,697 B2 * 1/2013 Zraik ..... H01R 13/502 439/321
8,366,481 B2 * 2/2013 Ehret ..... H01R 9/05 439/578
8,444,433 B2 5/2013 Snyder et al.
8,469,739 B2 6/2013 Rodrigues et al.
8,491,334 B2 * 7/2013 Rodrigues ..... H01R 9/0524 439/584
8,556,656 B2 * 10/2013 Thomas ..... H01R 9/0521 439/584
8,579,658 B2 11/2013 Youtsey
8,632,360 B2 * 1/2014 Tremba ..... H01R 9/0524 439/578
8,690,603 B2 4/2014 Bence et al.
8,753,147 B2 6/2014 Montena
8,834,200 B2 * 9/2014 Shaw ..... H01R 13/46 439/578
8,840,429 B2 9/2014 Thomas et al.
8,888,526 B2 * 11/2014 Burris ..... H01R 13/6581 439/578
8,894,440 B2 11/2014 Rodrigues et al.
8,915,751 B2 12/2014 Wood
8,944,846 B2 2/2015 Lee
9,039,446 B2 * 5/2015 Youtsey ..... H01R 9/0518 439/584
9,048,599 B2 * 6/2015 Burris ..... H01R 24/38
9,071,019 B2 6/2015 Burns et al.
9,083,113 B2 7/2015 Wild et al.
9,257,780 B2 2/2016 Thomas et al.
2002/0164900 A1 11/2002 Youtsey
2004/0048514 A1 3/2004 Kodaira
2005/0148236 A1 7/2005 Montena
2007/0020973 A1 * 1/2007 Sattele ..... H01R 13/627 439/101
2007/0049113 A1 * 3/2007 Rodrigues ..... H01R 9/0524 439/578
2009/0053928 A9 2/2009 Entsfellner
2010/0261380 A1 10/2010 Skeels et al.
2010/0297875 A1 11/2010 Purdy et al.
2012/0021642 A1 1/2012 Zraik
2012/0270439 A1 10/2012 Tremba et al.
2012/0329311 A1 12/2012 Duval et al.
2013/0330967 A1 12/2013 Youtsey
2014/0248798 A1 9/2014 Youtsey
2014/0342594 A1 11/2014 Montena
2015/0050825 A1 2/2015 Krenceski et al.
2015/0118901 A1 4/2015 Burris
2015/0162675 A1 6/2015 Davidson, Jr. et al.
2015/0180141 A1 6/2015 Wei

* cited by examiner

COAXIAL CABLE CONNECTOR WITH COMPRESSION BANDS

CROSS-REFERENCE TO RELATED APPLICATIONS

This application is a continuation of pending U.S. patent application Ser. No. 14/275,219, filed May 12, 2014, which claimed the benefit of and was a continuation-in-part application of U.S. patent application Ser. No. 13/739,972, filed Jan. 11, 2013, which claimed the benefit of U.S. Provisional Application No. 61/658,087, filed Jun. 11, 2012, all of which are hereby incorporated by reference.

FIELD OF THE INVENTION

The present invention relates generally to electrical apparati, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be fit with cable connectors to be coupled to electrical devices. Connectors typically have a connector body, a threaded fitting mounted for rotation on an end of the connector body, a bore extending into the connector body from an opposed end to receive the coaxial cable, and an inner post within the bore coupled in electrical communication with the fitting. Generally, connectors are crimped onto a prepared end of a coaxial cable to secure the connector to the coaxial cable. However, crimping occasionally results in a crushed coaxial cable which delivers a signal degraded by leakage, interference, or poor grounding. Furthermore, while some connectors are so tightly mounted to the connector body that threading the connector onto an electrical can be incredibly difficult, other connectors have fittings that are mounted so loosely on the connector body that the electrical connection between the fitting and the inner post can be disrupted when the fitting moves off of the post.

SUMMARY OF THE INVENTION

According to the principle of the invention, an embodiment of a coaxial cable connector includes an outer barrel, a compression collar applied to a rear end of the outer barrel, and a threaded fitting mounted for rotation to a front end of the outer barrel. The outer barrel has an inner compression band, and the compression collar has an outer compression band encircling the inner compression band formed in the outer barrel. The inner and outer compression bands moved between uncompressed and compressed positions in response to axial compression of the connector. In the compressed condition, the outer compression band bears against the inner compression band to deform the inner compression band radially inward.

According to the principle of the invention, an embodiment of a coaxial cable connector includes a cylindrical body, a fitting mounted for rotation to the body, and an alignment mechanism carried between the body and the fitting. The alignment mechanism is compressed between the body and the fitting so as to exert an axial force against the fitting to maintain contact between the fitting and the body. The alignment mechanism includes a quasi-annular leaf spring formed integrally to the body.

According to the principle of the invention, an embodiment of a coaxial cable connector includes an outer barrel with a longitudinal axis, the outer barrel formed with a compression band. A coaxial fitting is mounted to a front end of the outer barrel for coupling to an electrical device. A coaxial compression collar is applied to the outer barrel. An outer compression band, formed in the compression collar, moves between an uncompressed condition and a compressed condition in response to axial compression of the coaxial cable connector. The movement of the outer compression band from the uncompressed condition to the compressed condition shapes the inner compress band into a pawl which allows introduction of a cable into the coaxial cable connector and then prevents removal of the cable therefrom.

BRIEF DESCRIPTION OF THE DRAWINGS

Referring to the drawings.

DETAILED DESCRIPTION

Figure 1:
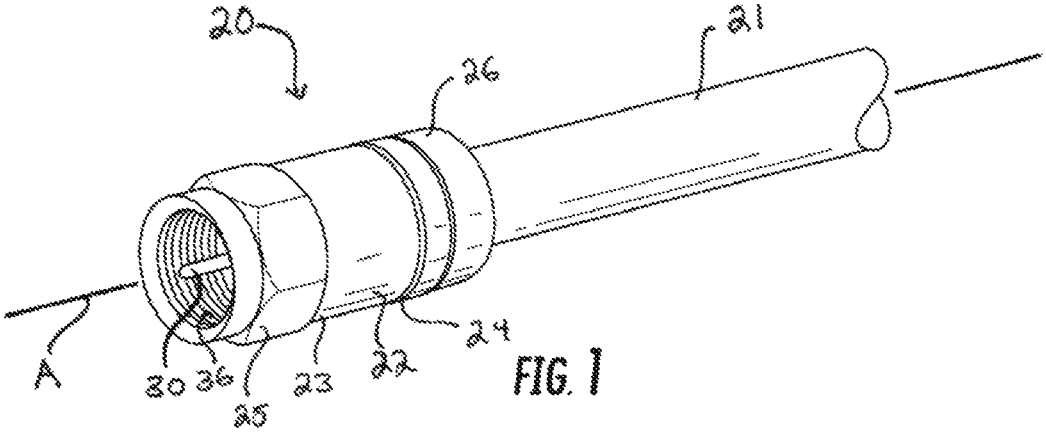
FIG. 1 is a perspective view of a coaxial cable connector constructed and arranged according to the principles of the invention, having a fitting, an outer barrel, and a compression collar, the coaxial cable connector installed in a compressed condition applied to a coaxial cable.

Reference now is made to the drawings, in which the same reference characters are used throughout the different figures to designate the same elements. FIG. 1 illustrates a coaxial cable connector 20 constructed and arranged in accordance with the principles of the invention, as it would appear in a compressed condition crimped onto a coaxial cable 21. The embodiment of the connector 20 shown is an F connector for use with an RG6 coaxial cable for purposes of example, but it should be understood that the description below is also applicable to other types of coaxial cable connectors and other types of cables. The connector 20 includes a body 22 having opposed front and rear ends 23 and 24, a coupling nut or threaded fitting 25 mounted for rotation on the front end 23 of the body 22, and a compression collar 26 mounted to the rear end 24 of the body 22. The connector 20 has rotational symmetry with respect to a longitudinal axis A illustrated in FIG. 1. The coaxial cable 21 includes an inner conductor 30 and extends into the connector 20 from the rear end 24 in the applied condition of the connector 20. The inner conductor 30 extends through the connector 20 and projects beyond the fitting 25.

Figure 2A:
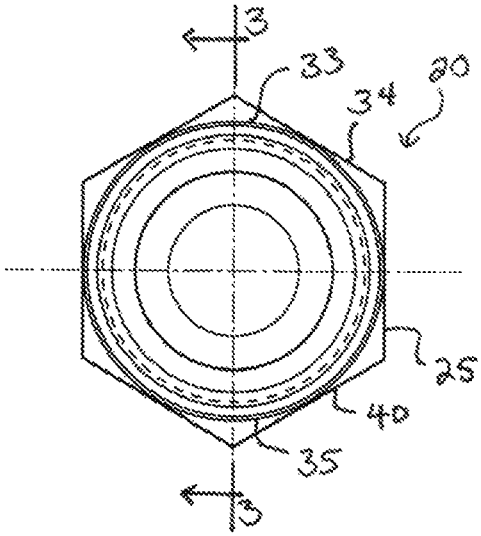
FIGS. 2A and 2B are front and side elevations, respectively, of the coaxial cable connector of FIG. 1.
Figure 2B:
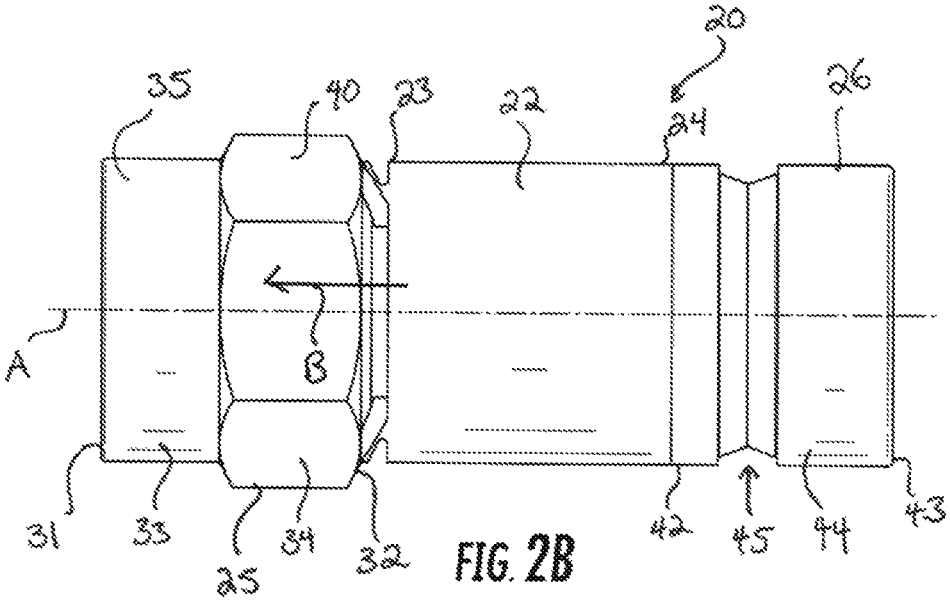
Figure 3A:
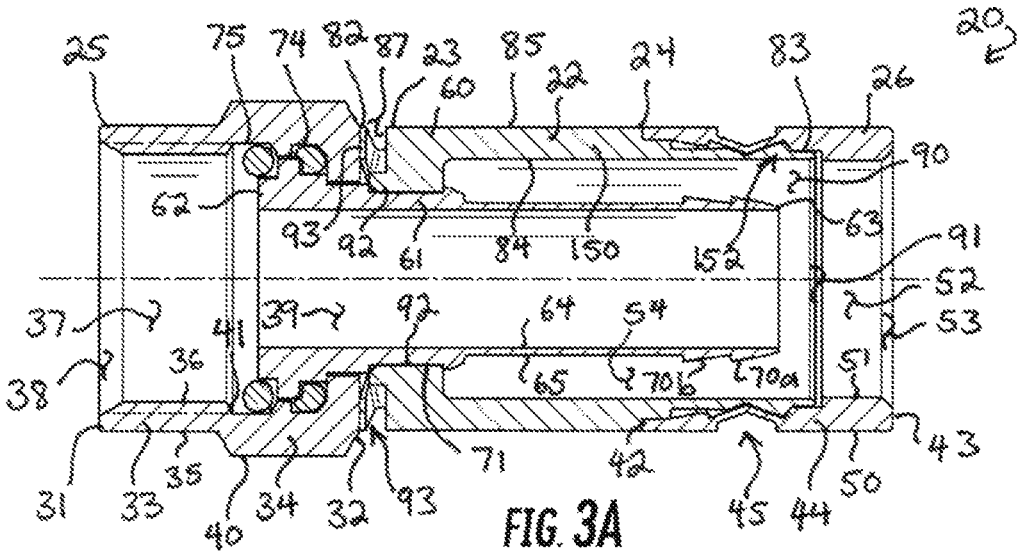
FIGS. 3A and 3B are section views of the coaxial cable connector of FIG. 1 taken along line 3-3 in FIG. 2A in an uncompressed condition and in a compressed condition, respectively.

FIGS. 2A and 2B show the connector 20 in greater detail in an uncompressed condition not applied to the coaxial cable 21. The fitting 25 is a sleeve having opposed front and rear ends 31 and 32, an integrally-formed ring portion 33 proximate to the front end 31, and an integrally-formed nut portion 34 proximate to the rear end 32. Referring also to FIG. 3A, the ring portion 33 has a smooth annular outer surface 35 and an opposed threaded inner surface 36 for engagement with an electrical device. Briefly, as a matter of explanation, the phrase "electrical device," as used throughout the description, includes any electrical device having a female post to receive a male coaxial cable connector 20 for the transmission of RF signals such as cable television, satellite television, internet data, and the like. The nut portion 34 of the fitting 25 has a hexagonal outer surface 40 to receive the jaws of a tool and an opposed grooved inner surface 41 (shown in FIG. 3A) to receive gaskets and to engage with the body 22 of the connector 20. Referring momentarily to FIG. 3A, an interior space 37 extends into the fitting 25 from a mouth 38 formed at the front end 31 of the fitting 25, to an opening 39 formed at the rear end 32, and is bound by the inner surfaces 36 and 41 of the ring and nut portions 33 and 34, respectively. Two annular channels 74 and 75 extend from the interior space 37 into the nut portion 34 from the inner surface 41 continuously around the nut portion 34. With reference back to FIG. 2B, the nut portion 34 of the fitting 25 is mounted on the front end 23 of the body 22 for rotation about axis A. The fitting 25 is constructed of a material or combination of materials having strong, hard, rigid, durable, and high electrically-conductive material characteristics, such as metal.

Referring still to FIG. 2B, the compression collar 26 has opposed front and rear ends 42 and 43, an annular sidewall 44 extending between the front and rear ends 42 and 43, and an annular outer compression band 45 formed in the sidewall 44 at a location generally intermediate along axis A between the front and rear ends 42 and 43 of the compression collar 26. Referring now to FIG. 3A, the compression collar 26 has a smooth annular outer surface 50 and an opposed smooth annular inner surface 51. An interior space 52 bound by the inner surface 51 extends into the compression collar 26 from a mouth 53 formed at the rear end 43 of the compression collar 26 to an opening 54 formed at the front end 42. The interior space 52 is a bore shaped and sized to receive the coaxial cable 21. The compression collar 26 is friction fit onto rear end 24 of the body 22 of the connector 22 proximate to the opening 54 to limit relative radial, axial, and rotational movement of the body 22 and the compression collar 26 about and along axis A, respectively. The compression collar 26 is constructed of a material or combination of materials having strong, hard, rigid, and durable material characteristics, such as metal, plastic, and the like.

With continuing reference to FIG. 3A, the body 22 of the connector 20 is an assembly including a cylindrical outer barrel 60 and a cylindrical, coaxial inner post 61 disposed within the outer barrel 60. The inner post 61 is an elongate sleeve extending along axis A and having rotational symmetry about axis A. The inner post 61 has opposed front and rear ends 62 and 63 and opposed inner and outer surfaces 64 and 65. The outer surface 65 at the rear end 63 of the inner post 61 is formed with two annular ridges 70*a* and 70*b* projecting toward the front end 62 and radially outward from axis A. As the term is used here, "radial" means aligned along a radius extending from the axis A. Moreover, the term "axial" means extending or aligned parallel to the axis A. The ridges 70*a* and 70*b* are spaced apart from each other along the rear end 63 of the inner post 61. The ridges 70*a* and 70*b* provide grip on a cable applied to the coaxial cable connector 20.

Figure 3B:
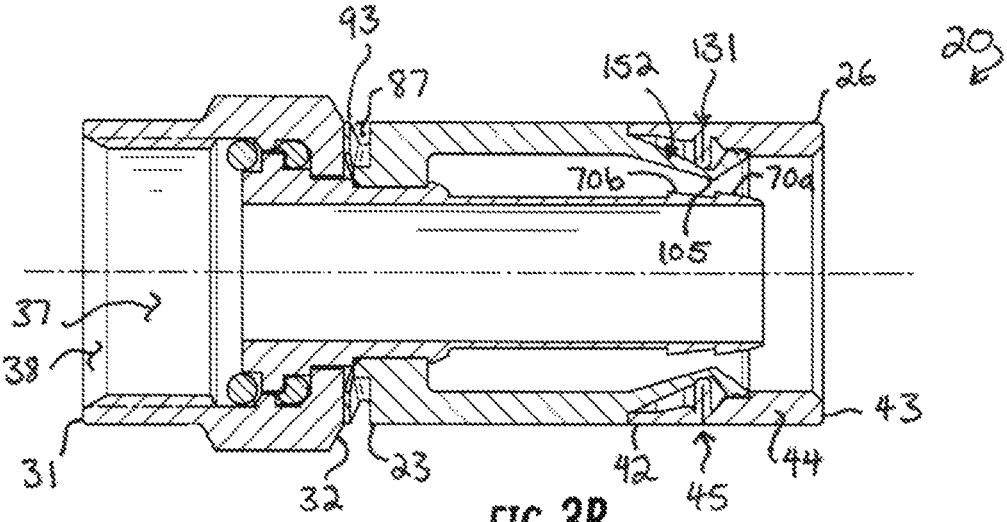
Figure 3C:
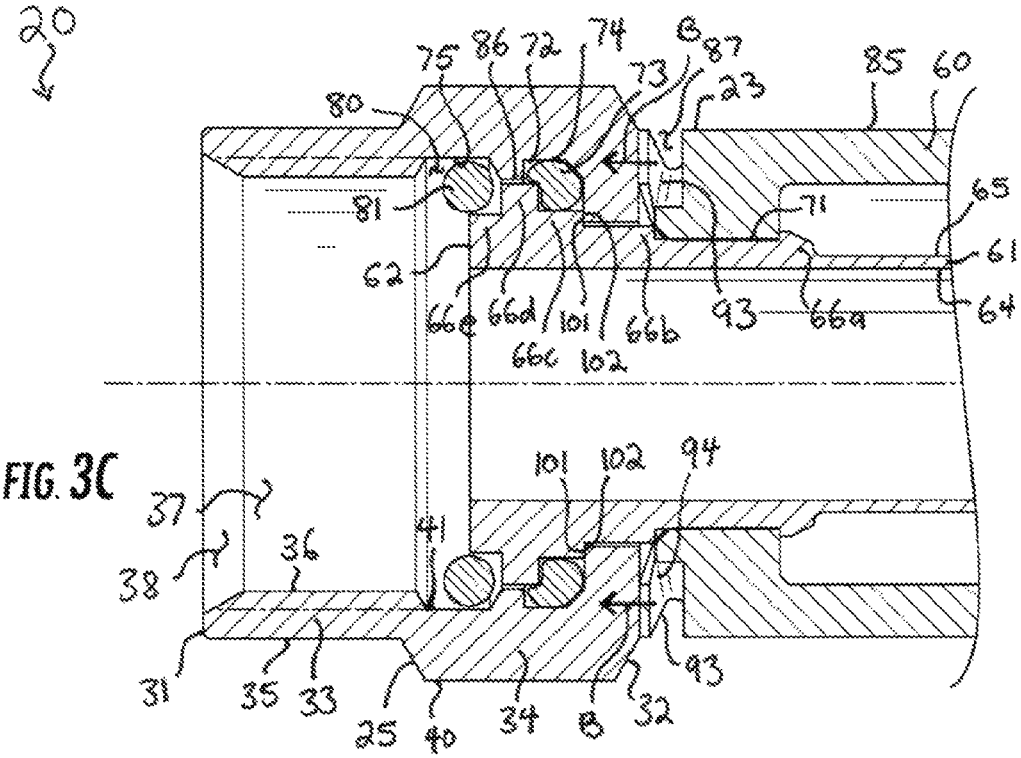
FIGS. 3C and 3D are enlarged section views of the coaxial cable connector of FIG. 1 taken along line 3-3 in FIG. 2A.

Referring now to the enlarged view of FIG. 3C, the outer surface 65 of the inner post 61 is formed with a series of outwardly-directed flanges 66*a*, 66*b*, 66*c*, 66*d*, and 66*e* spaced along the inner post 61 proximate to the front end 62. Each flange has a similar structure and projects radially away from the axis A; flanges 66*a* and 66*d* each include a front face directed toward the front end 62 of the inner post 61 and a rear face directed toward the rear end 63 of the inner post 61; flanges 66*b* and 66*c* each include a rear face directed toward the rear end 63 of the inner post 61; and flange 66*e* includes a front face directed toward the front end 62 of the inner post 61. Each of the flanges 66*a*-66*e* extends to a different radial distance away from the axis A. Flanges 66*a* and 66*b* form an annular dado or channel 71 around the inner post 61 defined between the front face of the flange 66*a* and the rear face of the flange 66*b*. The outer barrel 60 is coupled to the inner post 61 at the channel 71.

Referring still to FIG. 3C, the rear end 32 of the fitting 25 cooperates with the inner surface 41 of the nut portion 34 at the channel 74, the outer surface 65 of the inner post 61 at the flange 66*c*, and the rear face of the flange 66*d* to form a first toroidal volume 72 between the inner post 61 and the nut portion 34 for receiving a ring gasket 73. Additionally, the inner surface 41 of the nut portion 34 at the channel 75 cooperates with the front face of the flange 66*d* and the outer surface 65 of the inner post 61 at the flange 66*e* to form a second toroidal volume 80 between the inner post 61 and the nut portion 34 for receiving a ring gasket 81. The fitting 25 is supported and carried on the inner post 61 by the ring gaskets 73 and 81, and the ring gaskets 73 and 81 prevent the introduction of moisture into the connector 20. The inner post 61 is constructed of a material or combination of materials having hard, rigid, durable, and high electrically-conductive material characteristics, such as metal, and the ring gaskets 73 and 81 are constructed from a material or combination of materials having deformable, resilient, shape-memory material characteristics.

Returning now to FIG. 3A, the outer barrel 60 is an elongate, cylindrical sleeve extending along axis A with rotational symmetry about axis A. The outer barrel 60 has a sidewall 150 with opposed front and rear ends 82 and 83 and opposed inner and outer surfaces 84 and 85. The inner surface 84 defines and bounds an interior cable-receiving space 90 shaped and sized to receive the coaxial cable 21, and in which the rear end 63 of the inner post 61 is disposed. An opening 91 at the rear end 83 of the outer barrel 60 communicates with the interior space 52 of the compression collar 26 and leads into the interior cable-receiving space 90. The front end 82 of the outer barrel 60 is formed with an inwardly projecting annular lip 92. The lip 92 abuts and is received in the channel 71 in a friction-fit engagement, securing the outer barrel 60 on the inner post 61. The lip 92, together with the front end 23 of the body and the rear end 32 of the fitting 25, defines a circumferential groove 87 extending into the connector 20 from the outer surface 85 of the outer barrel 60.

Figure 2C:
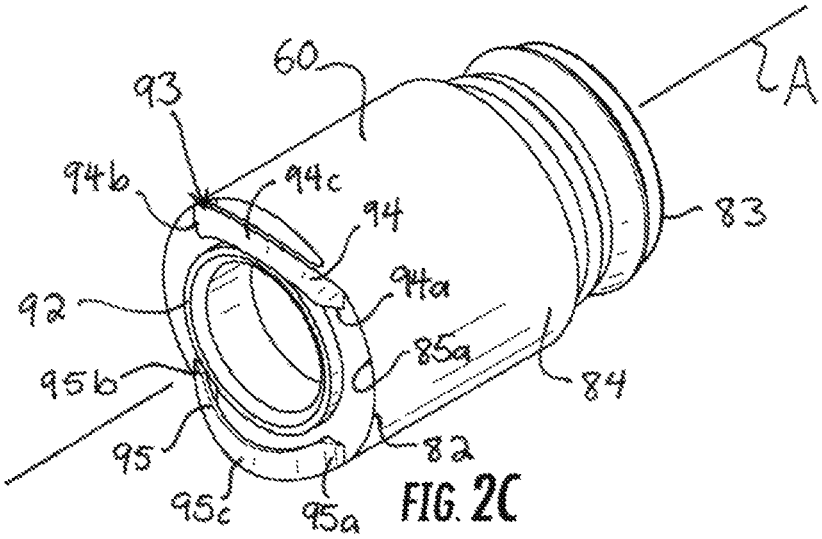
FIG. 2C is an isolated, perspective view of the outer barrel of the coaxial cable connector of FIG. 1.

The front end 82 of the outer barrel 60 is integrally formed with an alignment mechanism 93 disposed in the circumferential groove 87 between the outer barrel 60 and the fitting 25 to exert an axial force between the outer barrel 60 and the fitting 25 to maintain contact between the fitting 25 and the inner post 61 of the body 22. As seen in FIG. 2C, which illustrates the outer barrel 60 in isolation, the alignment mechanism 93 includes two springs 94 and 95 carried between the lip 92 and a perimeter 85*a* of the outer barrel 60 along the outer surface 84. The spring 94 is a quasi-annular leaf having opposed ends 94*a* and 94*b* and a middle 94*c*. The spring 95 is a quasi-annular leaf having opposed ends 95*a* and 95*b* and a middle 95*c*. As it is used here, "quasi-annular" means a shape which arcuately extends across an arcuate segment of a circle less than a full circle. The springs 94 and 95 are leafs, formed of a flat, thin, elongate piece of sprung material. The springs 94 and 95 are quasi-annular with respect to the axis A. The ends 94*a* and 94*b* of the spring 94 are fixed to the front end 82 of the outer barrel 60, and the middle 94*c* is free of the front end 82, projecting axially away from the outer barrel 60 toward the fitting 25, so that the spring 94 has an arcuate curved shape across a radial span and a convex shape in an axial direction. The spring 94 flexes along the axis A in response to axial compression and the spring 94 is maintained in a compressed condition in which the middle 94*c* is proximate to the front end 82. In the compressed condition of the springs 94, the middle 94*c* is disposed along the perimeter 85*a* between the side of the lip 92 and the outer surface 84 of the outer barrel 60, and the spring 94 exerts an axial bias forward on the fitting 25.

Similarly, the ends 95*a* and 95*b* of the spring 95 are fixed to the front end 82 of the outer barrel 60, and the middle 95*c* is free of the front end 82, projecting axially away from the outer barrel 60 toward the fitting 25, so that the spring 95 has an arcuate curved shape across a radial span and an convex shape in an axial direction. The spring 95 flexes along the axis A in response to axial compression and the spring 95 is maintained a compressed condition in which the middle 95*c* is proximate to the front end 82. In the compressed condition of the spring 95, the middle 95*c* is disposed between the side of the lip 92 and the outer surface 84 of the outer barrel 60, and the spring 95 exerts an axial bias forward on the fitting 25. In other embodiments, the alignment mechanism 93 includes several springs, or is a disc or annulus mounted on posts at the front end 23 of the outer barrel 60. Such alternate embodiments of the alignment mechanism 93 have an annularly sinusoidal or helicoid shaped about the axis A, and four forwardly-projecting, circumferentially spaced-apart contact points bearing against the fitting 25.

With reference now to FIG. 3C, the fitting 25 is mounted for free rotation on the inner post 61 about the axis A. To allow free rotation, the ring gaskets 73 and 81 space the nut portion 25 just off the inner post 61 in a radial direction, creating a gap 86 allowing for slight movement in the radial direction and allowing the fitting 25 to rotate with low rolling friction on the ring gaskets 73 and 81. When the fitting 25 is carried on the body 22 and is threaded onto or coupled to an electrical device, the alignment mechanism 93 is maintained in a compressed state, and the force exerted by the alignment mechanism 93 urges the fitting 25 in a forward direction along line B in FIG. 3C, causing the alignment mechanism 93 to bear against the fitting 25 and causing a contact face 101 on the rear end 32 of the fitting 25 to contact the rear face of the flange 66*c*, which is a contact face 102. The forwardly-directed force exerted by the alignment mechanism 93 overcomes the resistant spring force in the rearward direction caused by the compression of the ring gasket 73 within the toroidal volume 72. In this way, a permanent, low-friction connection is established that allows the fitting 25 to rotate freely upon the inner post 61 and maintains the fitting 25 and the inner post 61 in permanent electrical communication.

The outer barrel 60 is constructed of a material or combination of materials having strong, rigid, size- and shape-memory, and electrically-insulative material characteristics, as well as a low coefficient of friction, such as plastic or the like. The alignment mechanism 93, being integrally formed to the outer barrel 60, also has strong, rigid, size- and shape-memory, and electrically-insulative material characteristics, such that compression of the alignment mechanism 93 causes the alignment mechanism 93 to produce a counteracting force in the opposite direction to the compression, tending to return the alignment mechanism 93 back to an original configuration aligned and coaxial to the axis A, so that the fitting 25 is maintained coaxial to the axis A.

With continuing reference to FIG. 3C, the springs 94 and 95 are circumferentially, diameterically offset from each other in the circumferential groove 87. The middles 94*c* and 95*c* are diametrically offset, so as to provide an evenly distributed application of force from opposing sides of the body 22 toward the fitting 25. The acruate and convex shape of the springs 94 and 95 produces a reactive force in response to rearward movement of the fitting 25 when the fitting 25 is threaded onto or coupled to an electrical device, such that the fitting 25 is maintained in a coaxial, aligned state with respect to the axis A, thus maintaining continuity of the connection between the contact faces 101 and 102 completely around the inner post 61. Maintenance of the alignment and the connection ensures that a signal transmitted through the connector 20 is not leaked outside of the connector 20, that outside RF interference does not leak into the connector 20, and that the connector 20 remains electrically grounded. Further, the interaction of the two middles 94*c* and 95*c* with the rear end 32 of the fitting 25 has a low coefficient of friction due to the material construction of those structural features and the limited number of interference sites between the fitting 25 and the alignment mechanism 93. In other embodiments of the alignment mechanism 93, four contact points of the alignment mechanism 93 are evenly spaced to provide an evenly distributed application of force against the fitting 25 at the four contact points.

Referring back to FIG. 3A, the rear end 83 of the outer barrel 60 carries the compression collar 26. The sidewall 150 of the outer barrel 60 with a reduced thickness near the rear end 83 and defines an inner compression band 152. With reference now to the enlarged view of FIG. 3D, the inner compression band 152 includes a major ridge portion 103, a minor ridge portion 104, and a bend 105 formed therebetween. The major and minor ridge portions 103 and 104 have upstanding ridges projecting radially outwardly away from the axis A. The major ridge portion 103 is formed proximate to the rear end 83, the minor ridge portion 104 is formed forward of the major ridge portion 103, and the bend 105 is a flexible thin portion of the sidewall 150 between the major and minor ridge portions 103 and 104, defining a living hinge therebetween. The major ridge portion 103 has an oblique first face 110, which is an interference face, directed toward the rear end 83 of the outer barrel 60, and an oblique second face 111 directed toward the front end 82 of the outer barrel 60. The minor ridge portion 104 has an oblique first face 112, which is an interference face, directed toward the rear end 83 of the outer barrel 60, and an oblique second face 113 directed toward the front end 82 of the outer barrel 60. A V-shaped channel 114 is defined between the second and first faces 111 and 112, respectively. The major and minor ridge portions 103 and 104 are carried on the rear end 83 of the outer barrel 60 by a thin-walled ring 115 opposite the cable-receiving space 90 from the ridges 70*a* and 70*b* on the inner post 61. The thin-walled ring 115 is flexible and deflects radially inwardly toward the axis A in response to a radially-directed application of force. An annular shoulder 116, disposed inboard of the ring 115, has an upstanding abutment surface 120 proximate to the outer surface 85 of the outer barrel 60.

Figure 3D:
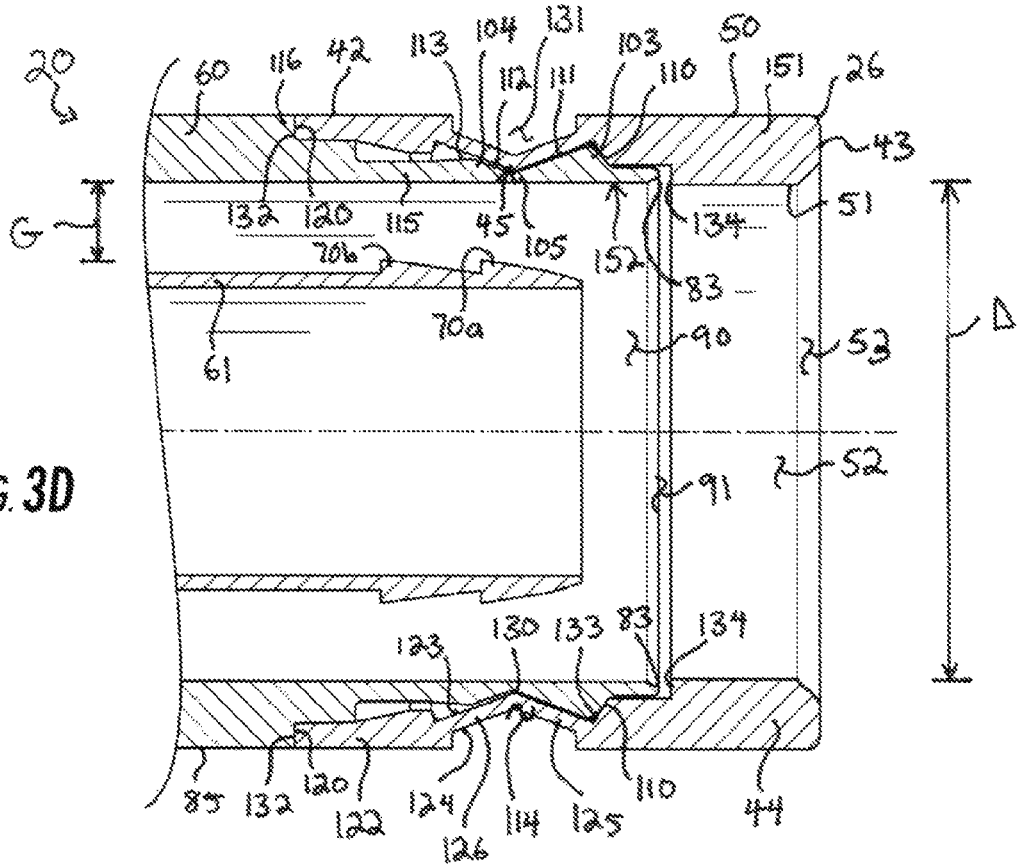

Referring still to FIG. 3D, the sidewall 44 of the compression collar 26 is narrowed at the front end 42 and forms the annular outer compression band 45. The compression collar 26 includes a ring 122 extending forwardly therefrom, an oblique face 133 proximal to the outer compression band 45 disposed between the outer compression band 45 and the inner surface 51, and an annular, upstanding shoulder 134 formed proximate to the rear end 43 and the inner surface 51 of the compression collar 26. The outer compression band 45 is a narrowed, notched portion of the sidewall 44 extending into the interior space 52 and having an inner surface 123 and an opposed outer surface 124, a first wall portion 125, an opposed second wall portion 126, and a flexible bend 130 at which the first and second wall portions 125 and 126 meet. The first and second wall portions 125 and 126 are rigid, and the bend 130 is a living hinge providing flexibility between the first and second wall portions 125 and 126. A compression space 131 is defined between the first and second wall portions 125 and 126 of the outer compression band 45. The ring 122 extends forwardly from the second wall portion 126 and terminates at a terminal edge 132, located in juxtaposition with the abutment surface 120 of the shoulder 116.

With reference still to FIG. 3D, fitted on the outer barrel 60, the compression collar 26 closely encircles the outer barrel 60, with the inner surface 51 of the compression collar 26 in direct contact in a friction-fit engagement with the outer surface 85 of the outer barrel 60 to limit relative radial, axial, and rotational movement. The inner compression band 152 of the outer barrel 60 receives and engages with the outer compression band 45 of the compression collar 26 to limit relative radial, axial, and rotational movement of the compression collar 26, with the shoulder 134 spaced apart from the rear end 83 of the outer barrel 60, the oblique face 133 of the compression collar 26 in juxtaposition with the first face 110 of the major ridge portion 103, the inner surface 123 of the outer compression band 45 along the first wall portion 125 in juxtaposition with the second face 111 of the major ridge portion 103, the bend 130 received in the channel 114 and against the bend 105, the inner surface 123 of the outer compression band 45 along the second wall portion 126 in juxtaposition with the first face 112 of the minor ridge portion 104, and the terminal edge 132 of the compression collar 26 in juxtaposition with the abutment surface 120 of the outer barrel 60, which arrangement defines a fitted condition of the compression collar 26 on the outer barrel 60.

Figure 4A:
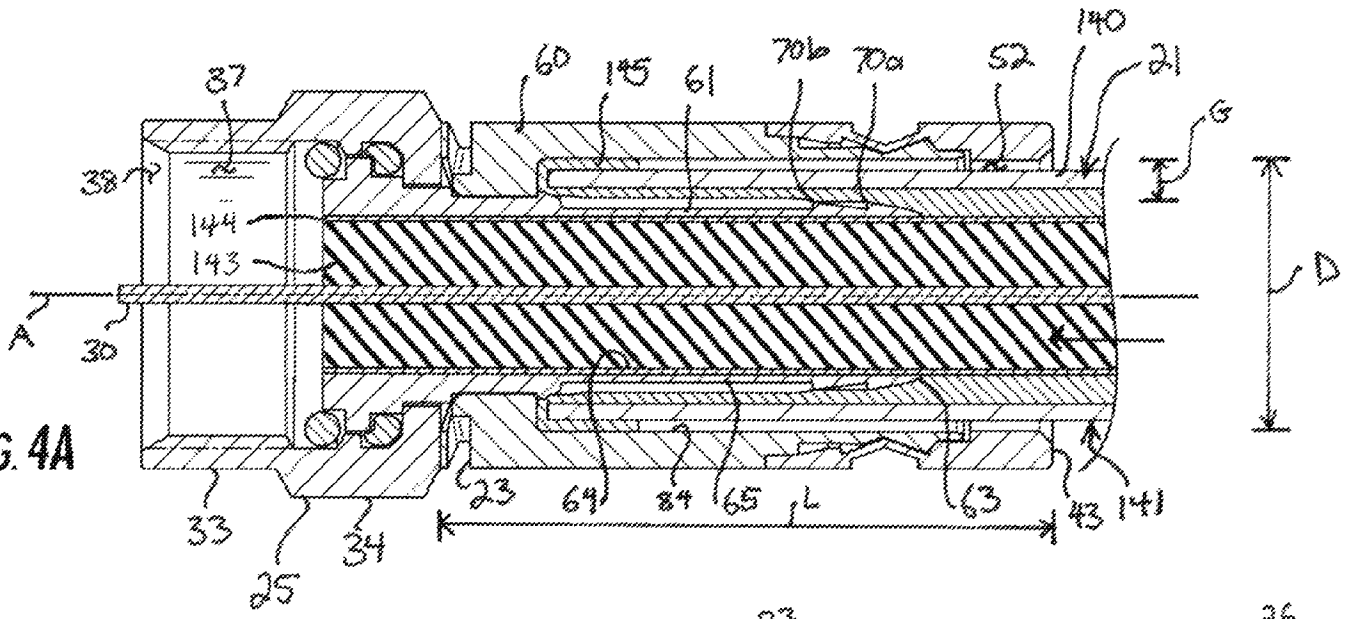
FIGS. 4A and 4B are section views of the coaxial cable connector of FIG. 1 taken along line 3-3 in FIG. 2A in an uncompressed condition and a compressed condition, respectively, applied to the coaxial cable.

In operation, the cable connector 20 is useful for coupling a coaxial cable 21 to an electrical device in electrical communication. To do so, the cable connector is secured to the coaxial cable 21 as shown in FIG. 4A. The coaxial cable 21 is prepared to receive the cable connector 20 by stripping off a portion of a jacket 140 at an end 141 of the coaxial cable 21 to expose an inner conductor 30, a dielectric insulator 143, a foil layer 144, and a flexible shield 145. The dielectric insulator 143 is stripped back to expose a predetermined length of the inner conductor 30, and the end of the shield 145 is turned back to cover a portion of the jacket 140. The end 141 of the coaxial cable 21 is then introduced into the connector 20 to arrange the connector 20 in an uncompressed condition, as shown in FIG. 4A. In this condition, the inner post 61 is disposed between the shield 145 and the foil layer 144 and is in electrical communication with the shield 145.

With reference still to FIG. 4A, to arrange the connector 20 into the uncompressed condition on the coaxial cable 21, the coaxial cable 21 is aligned with the axis A and passed into the interior space 52 of the compression collar 26 along a direction indicated by the arrowed line C. The coaxial cable 21 is then passed through the opening 91 and into the cable-receiving space 90 bound by the inner post 61, ensuring that the inner conductor is aligned with the axis A. The coaxial cable 21 continues to be moved forward along line C in FIG. 4A until the coaxial cable 21 encounters the rear end 63 of the inner post 61, where the shield 145 is advanced over the rear end 63 and the ridges 70*a* and 70*b* are placed in contact with the shield 145, and the portion of the shield 145 turned back over the jacket 140 is in contact with the inner surface 84 of the outer barrel 60. The foil layer 144 and the dielectric insulator 143 are also advanced forward within the inner post 61 against the inner surface 64 of the inner post 61. Further forward movement of the coaxial cable 21 along line C advances the coaxial cable to the position illustrated in FIG. 4A, with the free end of the dielectric insulator 143 disposed within the nut portion 34 of the fitting 25 and the inner conductor 30 extending through the interior space 37 of the ring portion 33 and projecting beyond the opening 38 of the fitting 25. In this arrangement, the shield 145 is in contact in electrical communication with the outer surface 65 of the inner post 61. Further, because the alignment mechanism 93 biases the fitting 25 into permanent electrical communication with the inner post 61, the shield 145 is also in electrical communication with the fitting 25 through the inner post 61, establishing shielding and grounding continuity between the connector 20 and the coaxial cable 21. With reference to FIGS. 3D and 4A, in the uncompressed condition of the connector 20, the outer barrel 60 has an inner diameter D, the inner surface 84 of the outer barrel 60 and the ridges 70*a* and 70*b* are separated by a distance G, and the length of the connector 20 from the front end 23 to the rear end 43 is length L. In embodiments in which the connector 20 is to be used with RG6 style coaxial-cables, the inner diameter D is approximately 8.4 millimeters, the distance G is approximately 1.4 millimeters, and the length L is approximately 19.5 millimeters. Other embodiments, such as would be used with other types of cables, will have different dimensions.

Figure 4B:
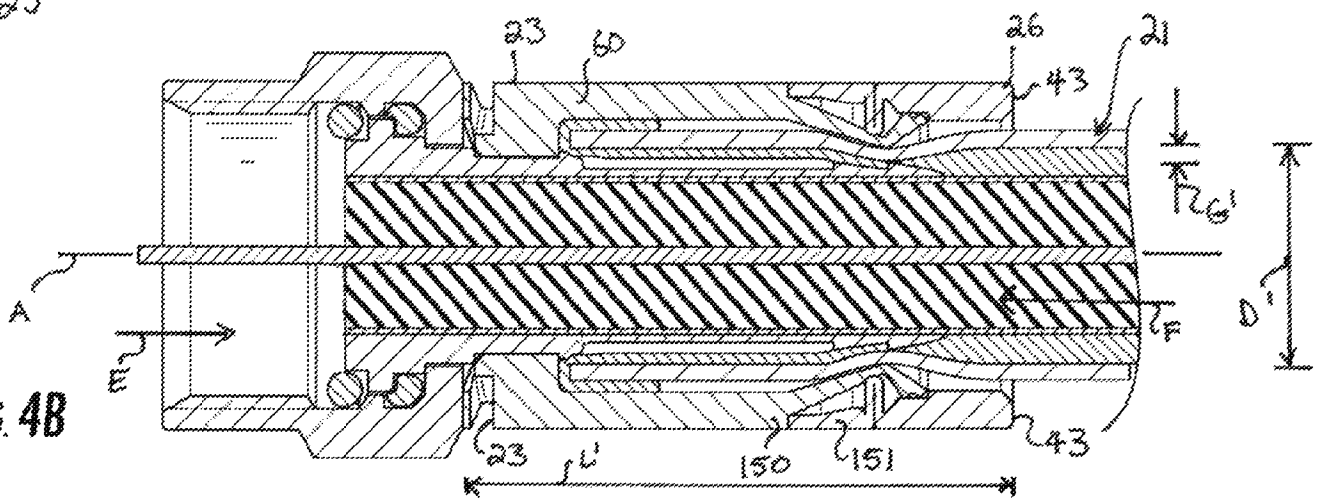

From the uncompressed condition, the connector 20 is moved into the compressed condition illustrated in FIG. 4B. The thin-walled inner and outer compression bands 152 and 45 of the outer barrel 60 and the compression collar 26, are useful for crimping down on the coaxial cable 21 to provide a secure, non-damaging engagement between the connector 20 and the coaxial cable 21. To compress the connector 20, the connector 20 is placed into a compressional tool which grips the connector 20 and compresses the connector 20 axially along the axis A from the front and rear ends 23 and 43 along arrowed lines E and F. The axial compressive forces along lines E and F subject the thinned sidewalls 150 and 44 of the outer barrel 60 and the compression collar 26, respectively, to stress, urging each to deform and bend in response to the stress.

Figure 5:
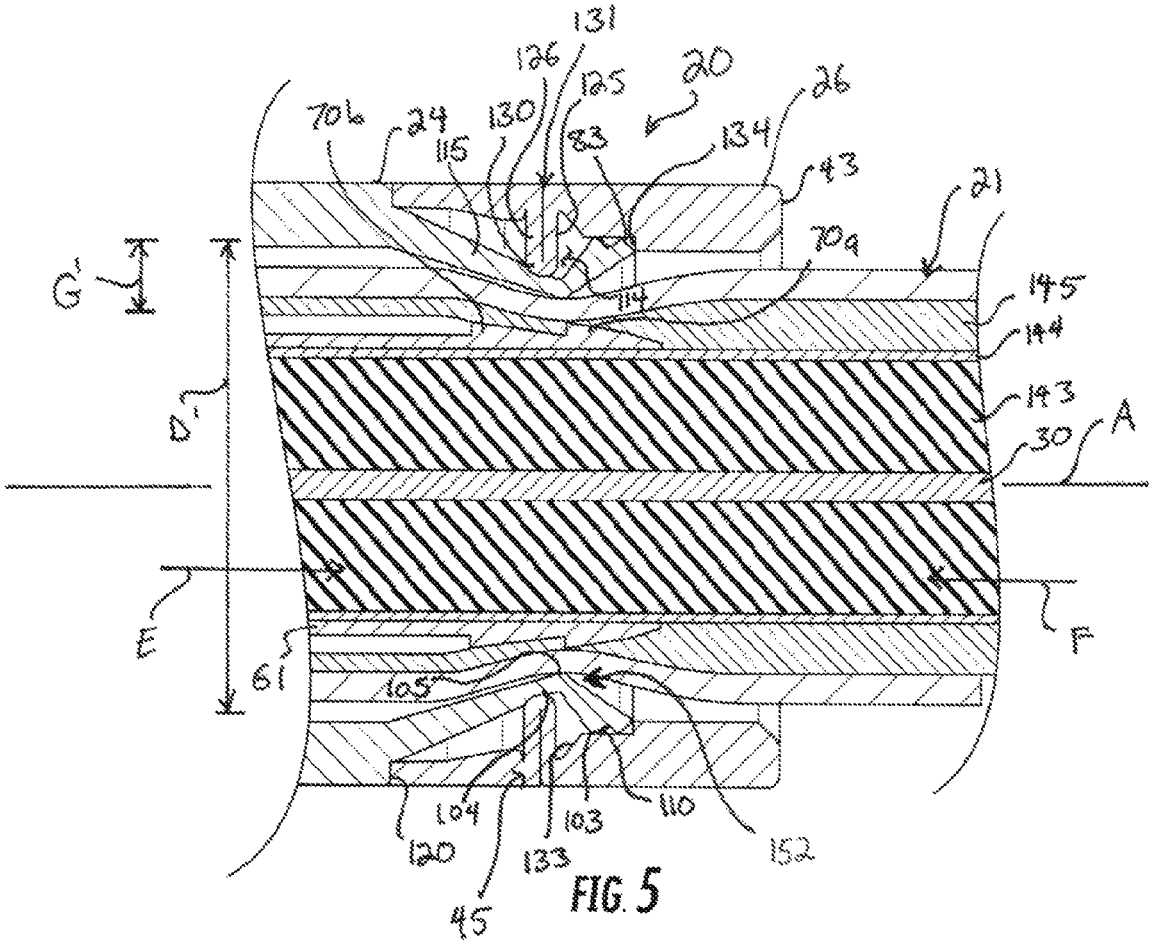
FIG. 5 is an enlarged view of FIG. 4B illustrating the coaxial cable connector of FIG. 1 in a compressed condition applied to the coaxial cable.

FIG. 5 is an enlarged view of the rear end 24 of the body 22 and the compression collar 26, with the coaxial cable 21 applied. As the compression tool operates, in response to the applied axial compressive force, the rear end 43 of the compression collar 26 is advanced toward the outer barrel 60, causing the compression collar 26 and outer barrel 60 to compress at the outer and inner compression bands 45 and 152, respectively. The oblique face 133 of the outer compression band 45 encounters the first face 110 of the major ridge portion 103 of the inner compression band 152 as the abutment surface 120 is advanced toward the compression collar 26. The oblique face 133 and the first face 110 are each oblique to the applied force and are parallel to each other, and the oblique face 133 and the first face 110 slide past each other obliquely to the axis A. The rear end 83 of the outer barrel 60 contacts and bears against the shoulder 134 of the compression collar 26, and as the first face 110 slides over the oblique face 133, the rear end 83 pivots in the shoulder 134, and the ring 115 deforms inwardly, causing the inner compression band 152 to buckle radially inward and the V-shaped channel 114 to deform inwardly. As the V-shaped channel 114 deforms inwardly, the outer compression band 45, under continuing compressive forces, buckles into the V-shaped channel 114. The first and second wall portions 125 and 126 are obliquely oriented inwardly toward the axis A, so that the axial compressive force causes the first and second wall portions 125 and 126 to deform radially inward toward the axis A and come together. The bend 130 is forced radially inward into the V-shaped channel 114 and bears against the bend 105 to deform the inner compression band 152 radially inward. The V-shaped channel 114 catches the buckling outer compression band 45, ensuring that the outer compression band 45 buckles radially, and as the major and minor ridge portions 103 and 104 buckle in response to pivoting and in response to contact with the outer compression band 45, the outer compression band 45 is further carried radially inward toward the ridges 70*a* and 70*b* by the deforming V-shaped channel 114.

Compression continues until the outer compression band 45 is closed such that the compression space 131 is eliminated, and the connector 20 is placed in the compressed condition illustrated in FIGS. 3B, 4B and 5. Although the process of moving the connector 20 from the uncompressed condition to the compressed condition is presented and described above as a series of sequential steps, it should be understood that the compression of the connector 20 on the coaxial cable 21 is preferably accomplished in one smooth, continuous motion, taking less than one second.

In the compressed condition of the connector 20, the inner diameter D of the connector 20 is altered to an inner diameter D', the inner surface of the outer barrel 60 and the barbs 70 are now separated by a distance G', and the length of the body 22 of the connector is now a length L', as indicated in FIG. 4B and FIG. 5. The distance G' is less than half the distance G, the inner diameter D' is approximately the inner diameter D less the distance G', and the length L' is less than the length L. In embodiments in which the connector 20 is to be used with RG6 style coaxial-cables, the inner diameter D' is approximately 6.7 millimeters, the distance G' is approximately 0.5 millimeters, and the length L' is approximately 18.0 millimeters. Other embodiments, such as would be used with other types of cables, will have different dimensions. As seen in FIG. 4B, this significant reduction in diameter causes the jacket 140 and the shield 145 of the coaxial cable 21 to become engaged and crimped between the bend 105 and the ridges 70*a* and 70*b*. Moreover, the bend 105 is opposed from the ridges 70*a* and 70*b* is disposed between the ridges 70*a* and 70*b*, so that the jacket 140 and shield 145 are crimped between the bend 105 and the ridges 70*a* and 70*b* at an axial location between the ridges 70*a* and 70*b*, preventing withdrawal of the coaxial cable 21 from the connector 20. The first and second wall portions 125 and 126 are oriented transversely and generally tangentially to the axis A to support the buckled inner compression band 152 in the buckled arrangement, and to resist withdrawal of the coaxial cable 21 by preventing the outwardly-directed movement of the inner compression band 152.

With continuing reference to FIG. 5, the rigid material characteristics of the inner post 61 prevents the inner post 61 from being damaged by the crimping. Furthermore, because the dielectric insulator 143 and inner conductor 30 are protected within the inner post 61 and the shield 145 is outside the inner post 61 in contact with the outer surface 65, the continuity of the connection between the shield 145 and the inner post 61 is maintained so that a signal transmitted through the connector 20 is not leaked outside of the connector 20, so that outside RF interference does not leak into the connector 20, and so that the connector 20 remains electrically grounded. The interaction between the shield 145 and the ridges 70*a* and 70*b*, which project forwardly and radially outward from axis A, further inhibit movement of the coaxial cable 21 rearward along a direction opposite to line F out of the connector 20, ensuring that the connector 20 is securely applied on the coaxial cable 21.

Figure 6A:
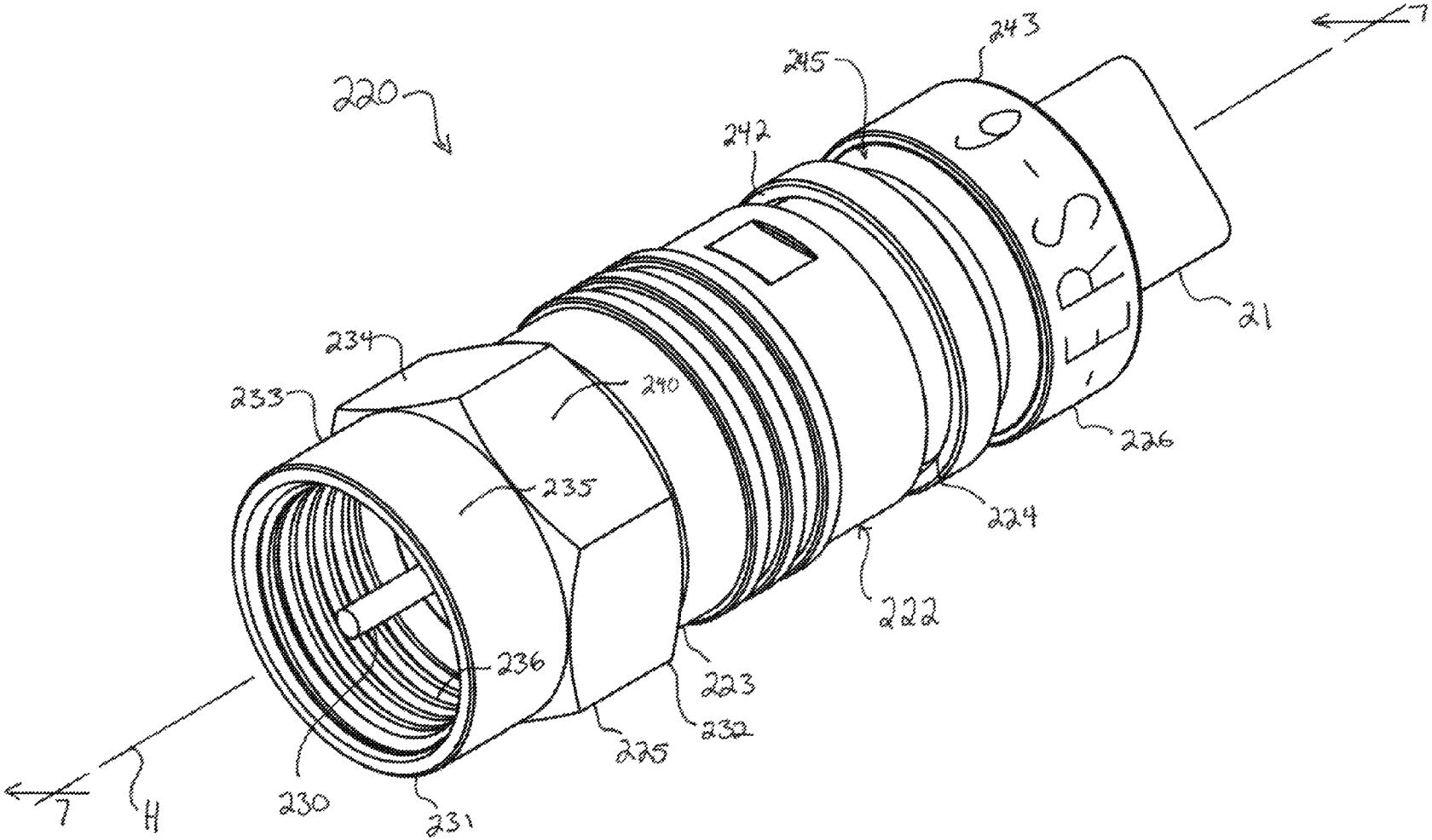
FIGS. 6A and 6B is a perspective view of an alternate embodiment of a coaxial cable connector constructed and arranged according to the principles of the invention, having a fitting, an outer barrel, and a compression collar, the coaxial cable connector installed in a uncompressed condition and a compressed condition, respectively applied to a coaxial cable.
Figure 6B:
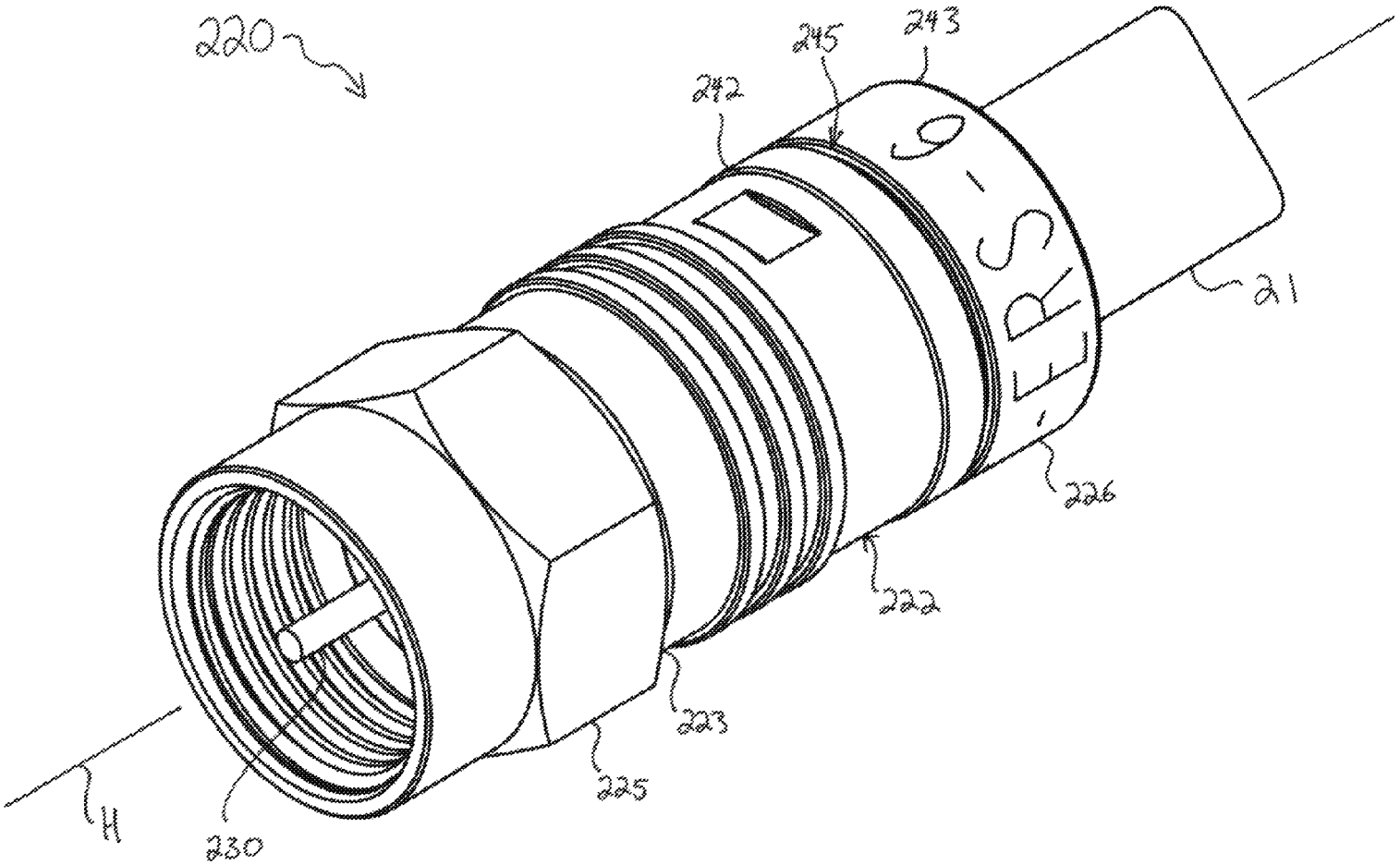

Turning now to FIGS. 6A-8C, an alternate embodiment of a coaxial cable connector 220, constructed and arranged in accordance with the principles of the invention, is shown. FIG. 6A illustrates the connector 220 as it would appear in an uncompressed condition crimped onto a coaxial cable 21. Like the connector 20, the embodiment of the connector 220 shown is an F connector for use with an RG6 coaxial cable for purposes of example, but it should be understood that the description below is also applicable to other types of coaxial cable connectors and other types of cables. The connector 220 includes a body 222 having opposed front and rear ends 223 and 224, a coupling nut or threaded fitting 225 mounted for rotation on the front end 223 of the body 222, and a compression collar 226 mounted to the rear end 224 of the body 222. The connector 220 has rotational symmetry with respect to a longitudinal axis H illustrated in both FIGS. 6A and 6B. The coaxial cable 221 includes an inner conductor 230 and extends into the connector 220 from the rear end 224 in the applied condition of the connector 220. The inner conductor 230 extends through the connector 220 and projects beyond the fitting 225.

Figure 7A:
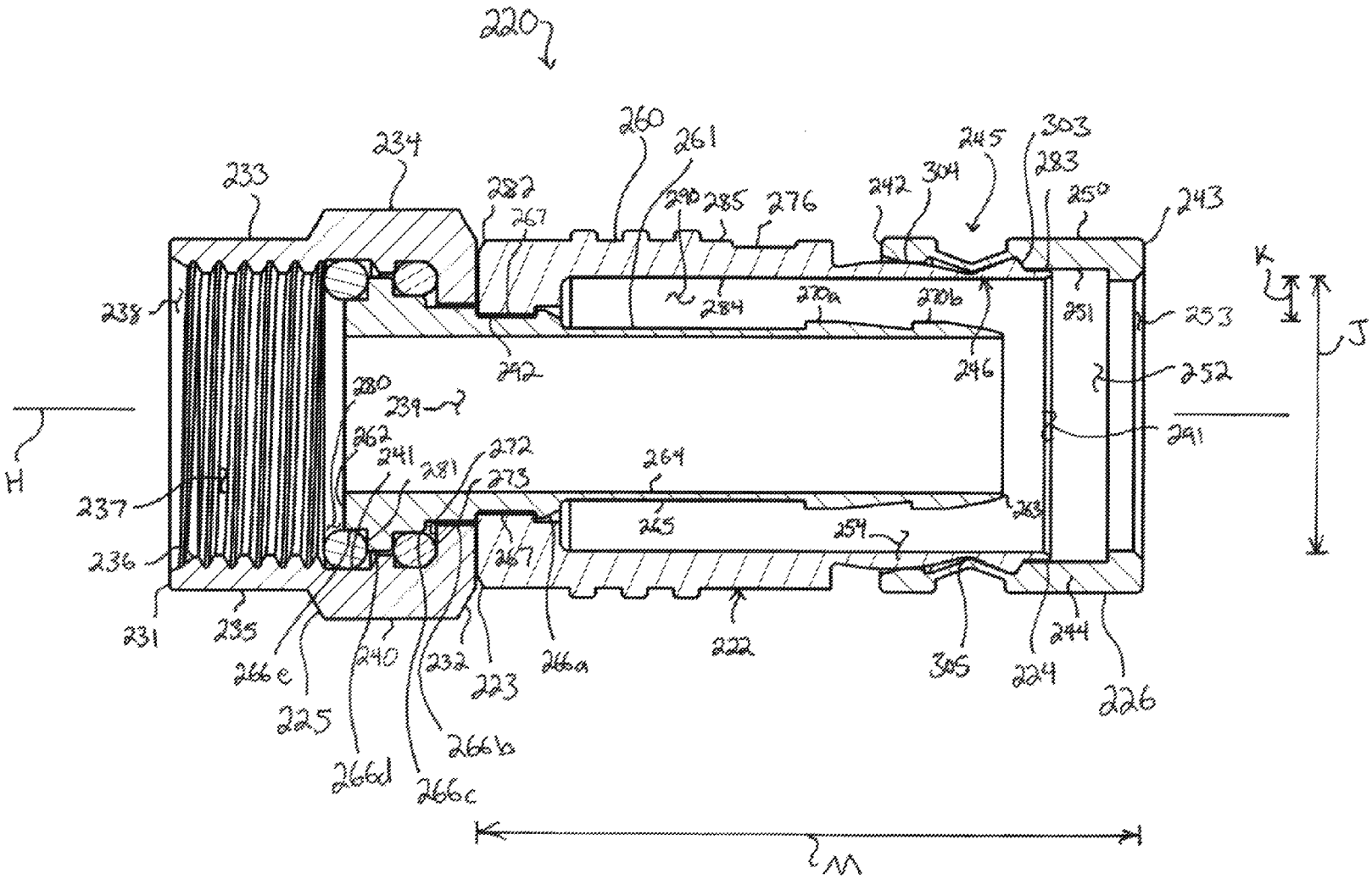
FIG. 7A is a section view of the coaxial cable connector of FIG. 6A taken along the line 7-7 in FIG. 6A.

Referring to FIG. 6A and also to FIG. 7A, which is a section view of the connector 220 taken along the line 7-7 in FIG. 6A but shown without the coaxial cable 221, it can be seen that the fitting 225 is a sleeve having opposed front and rear ends 231 and 232, an integrally-formed ring portion 233 proximate to the front end 231, and an integrally-formed nut portion 234 proximate to the rear end 232. The ring portion 233 has a smooth annular outer surface 235 and an opposed threaded inner surface 236 for engagement with an electrical device. The nut portion 234 of the fitting 225 has a hexagonal outer surface 240 to receive the jaws of a tool and an opposed grooved inner surface 241 (shown in FIG. 7A) to receive gaskets and to engage with the body 222 of the connector 220. Referring now to FIG. 7A, an interior space 237 extends into the fitting 225 from a mouth 238 formed at the front end 231 of the fitting 225, to an opening 239 formed at the rear end 232, and is bound by the inner surfaces 236 and 241 of the ring and nut portions 233 and 234, respectively. Two annular channels 274 and 275 extend outwardly from the interior space 237 into the nut portion 234 from the inner surface 241 continuously around the nut portion 234. The nut portion 234 of the fitting 225 is mounted proximate to the front end 223 of the body 22 for rotation about axis H. The fitting 225 is constructed of a material or combination of materials having strong, hard, rigid, durable, and high electrically-conductive material characteristics, such as metal.

Referring still to FIG. 7A the compression collar 226 has opposed front and rear ends 242 and 243, an annular sidewall 244 extending between the front and rear ends 242 and 243, and an annular outer compression band 245 formed in the sidewall 244 at a location generally intermediate along axis H between the front and rear ends 242 and 243 of the compression collar 226. The compression collar 226 has a smooth annular outer surface 250 and an opposed smooth annular inner surface 251. An interior space 252 bound by the inner surface 251 extends into the compression collar 226 from a mouth 253 formed at the rear end 243 of the compression collar 226 to an opening 254 formed at the front end 242. The interior space 252 is a cylindrical bore and is sized to receive the coaxial cable 221. The compression collar 226 is friction fit onto rear end 224 of the body 222 of the connector 220 proximate to the opening 254 to limit relative radial, axial, and rotational movement of the body 222 and the compression collar 226 about and along axis A, respectively. The compression collar 226 is constructed of a material or combination of materials having strong, hard, rigid, and durable material characteristics, such as metal, plastic, and the like.

The body 222 of the connector 220 is an assembly including a cylindrical outer barrel 260 and a cylindrical, coaxial inner post 261 disposed within the outer barrel 260. The inner post 261 is an elongate sleeve extending along axis H and having rotational symmetry about axis H. The inner post 261 has opposed front and rear ends 262 and 263 and opposed inner and outer surfaces 264 and 265. The outer surface 265 at the rear end 263 of the inner post 261 is formed with two annular ridges 270*a* and 270*b* projecting toward the front end 262 and radially outward from axis H. The ridges 270*a* and 270*b* are spaced apart from each other along the rear end 263 of the inner post 261. The ridges 270*a* and 270*b* provide grip on a coaxial cable applied to the coaxial cable connector 220 and provide an increased diameter over which the coaxial cable must be passed.

Referring still to the view of FIG. 7A, the outer surface 265 of the inner post 261 is formed with a series of outwardly-directed flanges 266*a*, 266*b*, 266*c*, 266*d*, and 266*e* spaced along the inner post 261 proximate to the front end 262. Each flange has a similar structure and projects radially away from the axis H; flanges 266*a* and 266*d* each include a front face directed toward the front end 262 of the inner post 261 and a rear face directed toward the rear end 263 of the inner post 261; flanges 266*b* and 266*c* each include a rear face directed toward the rear end 263 of the inner post 261; and flange 266*e* includes a front face directed toward the front end 262 of the inner post 261. Each of the flanges 266*a*-266*e* extends to a different radial distance away from the axis H. Flanges 266*a* and 266*b* form an annular dado or channel 267 around the inner post 261 defined between the front face of the flange 266*a* and the rear face of the flange 266*b*. The outer barrel 260 is coupled to the inner post 261 at the channel 267.

Referring still to FIG. 7A, the rear end 232 of the fitting 225 cooperates with the inner surface 241 of the nut portion 234 at the channel 274, the outer surface 265 of the inner post 261 at the flange 266*c*, and the rear face of the flange 266*d* to form a first toroidal volume 272 between the inner post 261 and the nut portion 234 for receiving a ring gasket 273. Additionally, the inner surface 241 of the nut portion 234 at the channel 275 cooperates with the front face of the flange 266*d* and the outer surface 265 of the inner post 261 at the flange 266*e* to form a second toroidal volume 280 between the inner post 261 and the nut portion 234 for receiving a ring gasket 281. The fitting 225 is supported and carried on the inner post 261 by the ring gaskets 273 and 281, and the ring gaskets 273 and 281 prevent the introduction of moisture into the connector 220. The inner post 261 is constructed of a material or combination of materials having hard, rigid, durable, and high electrically-conductive material characteristics, such as metal, and the ring gaskets 273 and 281 are constructed from a material or combination of materials having deformable, resilient, shape-memory material characteristics.

The outer barrel 260 is an elongate, cylindrical sleeve extending along axis H with rotational symmetry about axis H, and is constructed of a material or combination of materials having strong, rigid, size- and shape-memory, and electrically-insulative material characteristics, as well as a low coefficient of friction, such as plastic or the like. The outer barrel 260 has a sidewall 276 with opposed front and rear ends 282 and 283 and opposed inner and outer surfaces 284 and 285. The inner surface 284 defines and bounds an interior cable-receiving space 290 shaped and sized to receive the coaxial cable 221, and in which the rear end 263 of the inner post 261 is disposed. An opening 291 at the rear end 283 of the outer barrel 260 communicates with the interior space 252 of the compression collar 226 and leads into the interior cable-receiving space 290. The front end 282 of the outer barrel 260 is formed with an radially-inward projecting annular lip 292. The lip 292 abuts and is received in the channel 271 in a friction-fit engagement, securing the outer barrel 260 on the inner post 261.

With continuing reference to FIG. 7A the fitting 225 is mounted for free rotation on the inner post 261 about the axis H. To allow free rotation, the ring gaskets 273 and 281 space the nut portion 225 just off the inner post 261 in a radial direction, creating an annular gap between the inner post 261 and the nut portion 225 which allows for slight movement in the radial direction, and allows the fitting 225 to rotate with low rolling friction on the ring gaskets 273 and 281. In this way, a permanent, low-friction connection is established that allows the fitting 225 to rotate freely upon the inner post 261 while still maintaining the fitting 225 and the inner post 261 in permanent electrical communication.

Figure 7B:
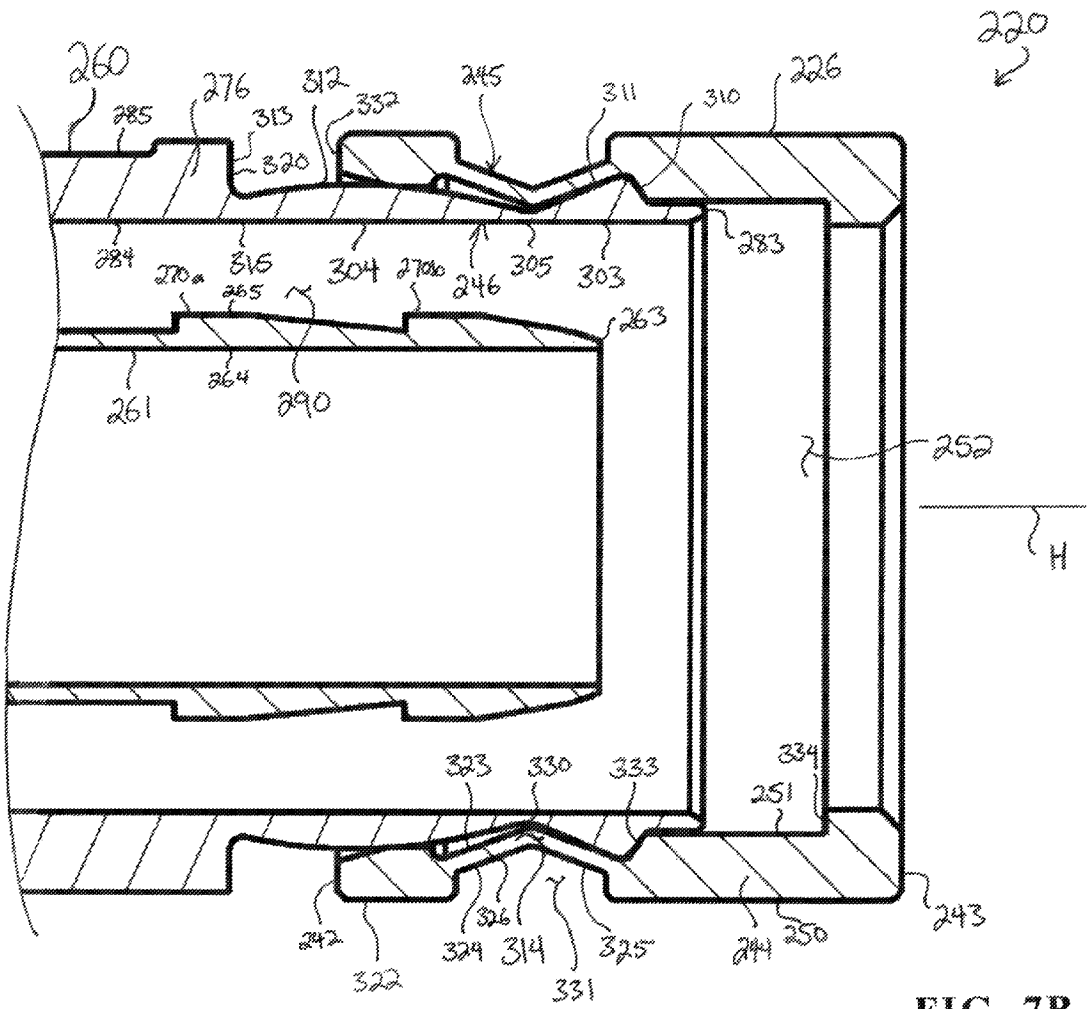
FIG. 7B is an enlarged section view of the coaxial cable connector of FIG. 6A taken along the line 7-7 in FIG. 6A showing the compression collar in detail.

Turning now to the enlarged view of FIG. 7B, the rear end 283 of the outer barrel 260 carries the compression collar 226. The sidewall 276 of the outer barrel 260 with a reduced thickness near the rear end 283 and defines an inner compression band 246. The inner compression band 246 includes a ridge portion 303, a rounded hump portion 304, and a bend 305 formed therebetween. The ridge and rounded portions 303 and 304 project radially outward away from the axis H. The ridge portion 303 is formed proximate to the rear end 283, the rounded hump portion 304 is formed forward of the ridge portion 303, and the bend 305 is a flexible thin portion of the sidewall 276 between the ridge and rounded portions 303 and 304, defining a living hinge therebetween. The ridge portion 303 has an oblique first face 310, which is an interference face, directed toward the rear end 283 of the outer barrel 260, and an oblique second face 311 directed toward the front end 282 of the outer barrel 260. The rounded hump portion 304 has a convex face 312 extending between the bend 305 and an annular shoulder 313. A V-shaped channel 314 is defined between the second face 311 of the ridge portion 303 and the convex face 312 of the rounded hump portion 304. The ridge portion 303 is carried on the rear end 283 of the outer barrel 260 by a thin-walled ring 315 at the base of the shoulder 313, opposite the cable-receiving space 290 from the ridges 270*a* and 270*b* on the inner post 261. The thin-walled ring 315 is flexible and deflects radially inwardly toward the axis H in response to a radially-directed application of force. The annular shoulder 316 has an upstanding abutment surface 320 proximate to the outer surface 285 of the outer barrel 260.

Referring still to FIG. 7B, the sidewall 244 of the compression collar 226 is narrowed proximate to the front end 242 and forms the annular outer compression band 245. The compression collar 226 includes a ring 322 extending forwardly therefrom, an oblique face 333 proximal to the outer compression band 245 disposed between the outer compression band 245 and the inner surface 251, and an annular, upstanding shoulder 334 formed proximate to the rear end 243 and the inner surface 251 of the compression collar 226. The outer compression band 245 is a narrowed, notched portion of the sidewall 244 extending into the interior space 252 and having an inner surface 323 and an opposed outer surface 324, a first wall portion 325, an opposed second wall portion 226, and a flexible bend 330 at which the first and second wall portions 325 and 326 meet. The first and second wall portions 325 and 326 are rigid, and the bend 330 is a living hinge providing flexibility between the first and second wall portions 325 and 326. A compression space 331 is defined between the first and second wall portions 325 and 326 of the outer compression band 245. The ring 322 extends forwardly from the second wall portion 326 and terminates at a terminal edge 332 at the front end 242, spaced apart longitudinally from the shoulder 313 of the outer barrel 260.

With reference still to FIG. 7, fit over the rear end 283 of the outer barrel 260, the compression collar 226 closely encircles the outer barrel 260, with the inner surface 251 of the compression collar 226 in direct contact in a friction-fit engagement with the outer surface 285 of the outer barrel 260 to limit relative radial, axial, and rotational movement. The inner compression band 246 of the outer barrel 260 receives and engages with the outer compression band 245 of the compression collar 226 to limit relative radial, axial, and rotational movement of the compression collar 226, with the shoulder 334 spaced apart from the rear end 283 of the outer barrel 260, the oblique face 333 of the compression collar 226 in juxtaposition with the first face 310 of the major ridge portion 303, the inner surface 323 of the outer compression band 245 along the first wall portion 325 in juxtaposition with the second face 311 of the ridge portion 303, the bend 330 received in the channel 314 and against the bend 305, the inner surface 323 of the outer compression band 245 along the second wall portion 326 spaced radially apart from the convex face 312 of the rounded hump portion 304, and the terminal edge 332 of the compression collar 226 spaced longitudinally apart from the abutment surface 320 on the shoulder 313 of the outer barrel 260, which arrangement defines a fitted condition of the compression collar 226 on the outer barrel 260.

Figure 8A:
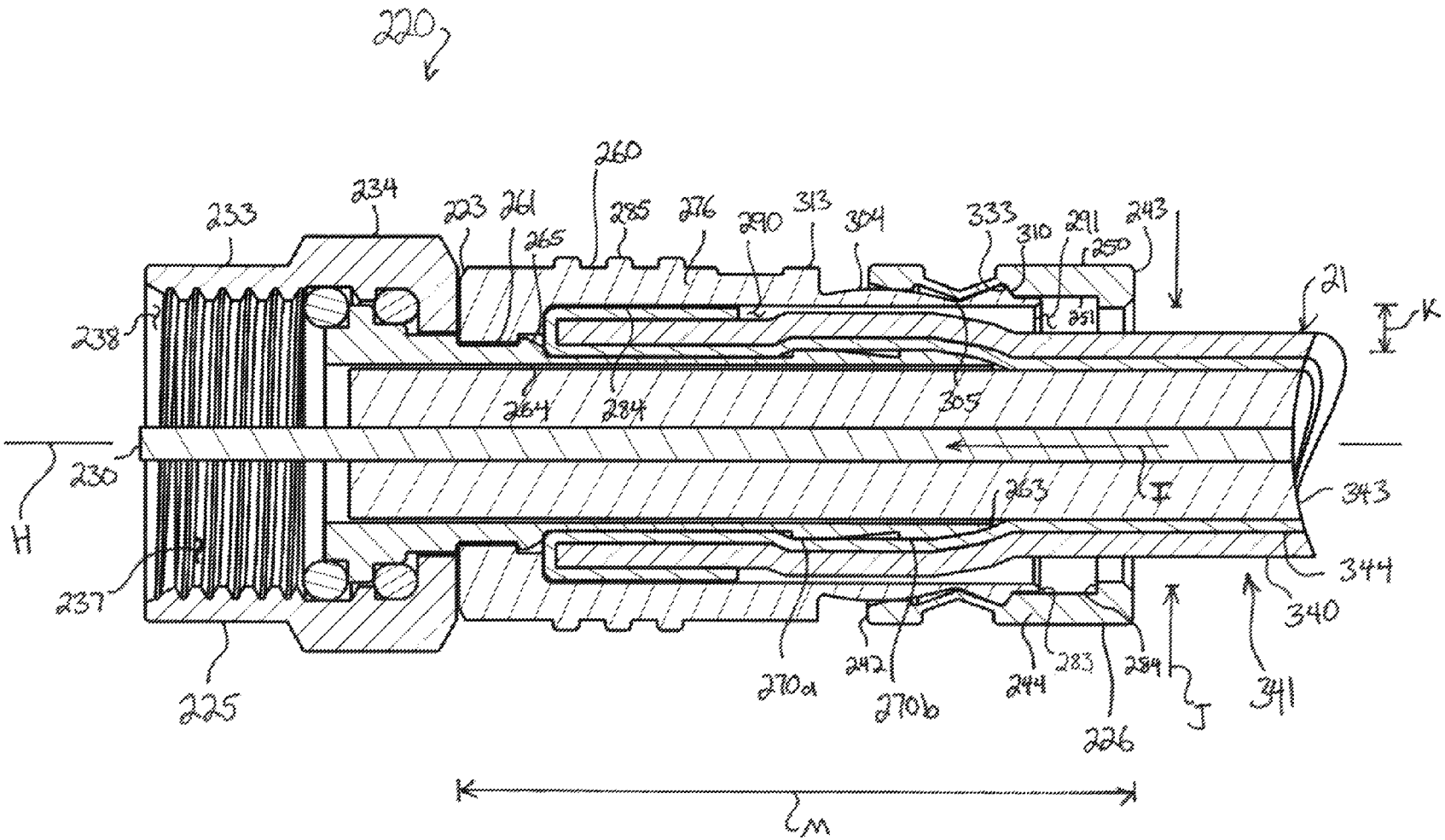
FIGS. 8A-8C are section views taken along the line 7-7 in FIG. 6A, showing a sequence of steps of applying the coaxial cable to the coaxial cable connector.
Figure 8B:
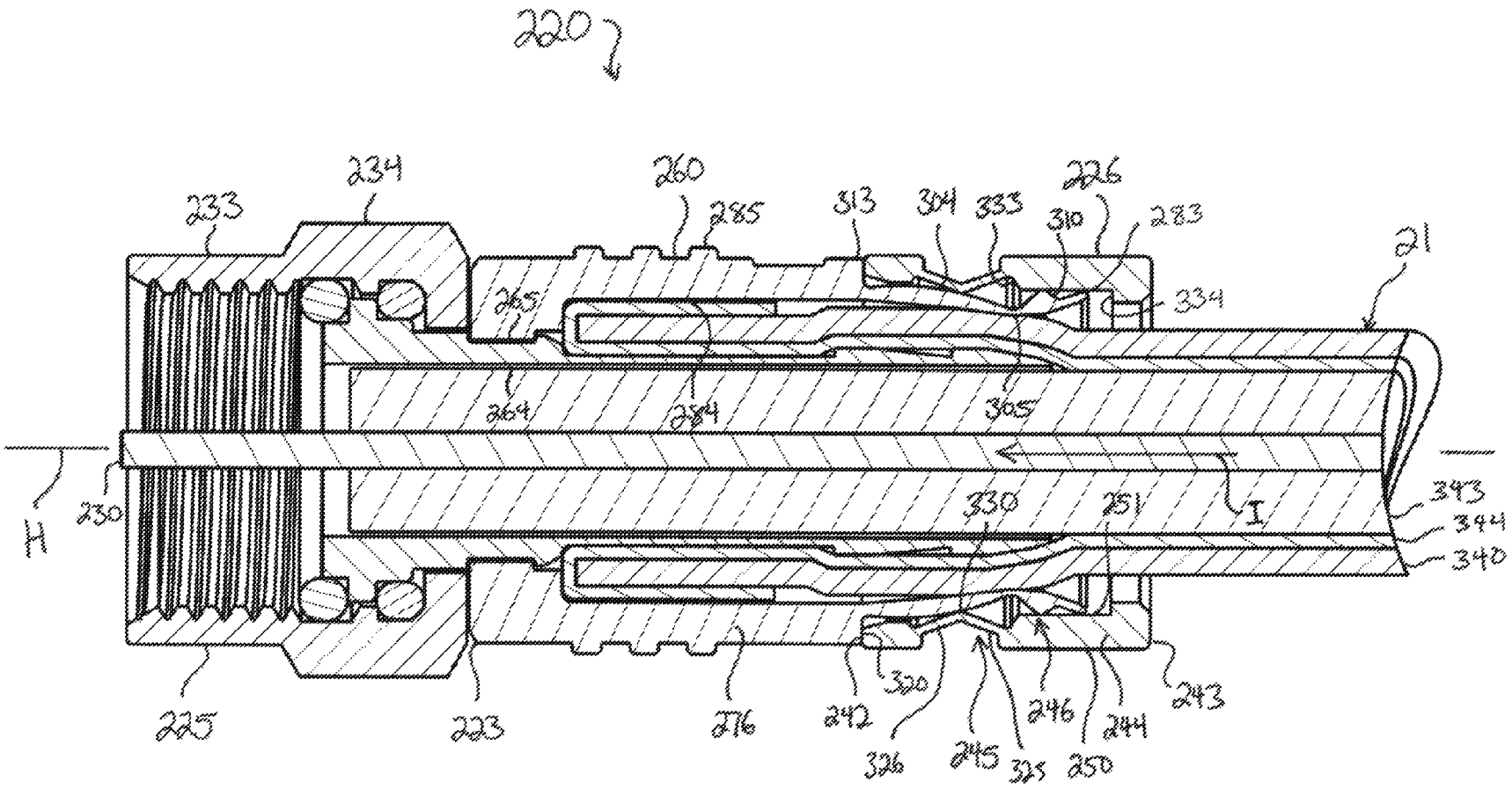
Figure 8C:
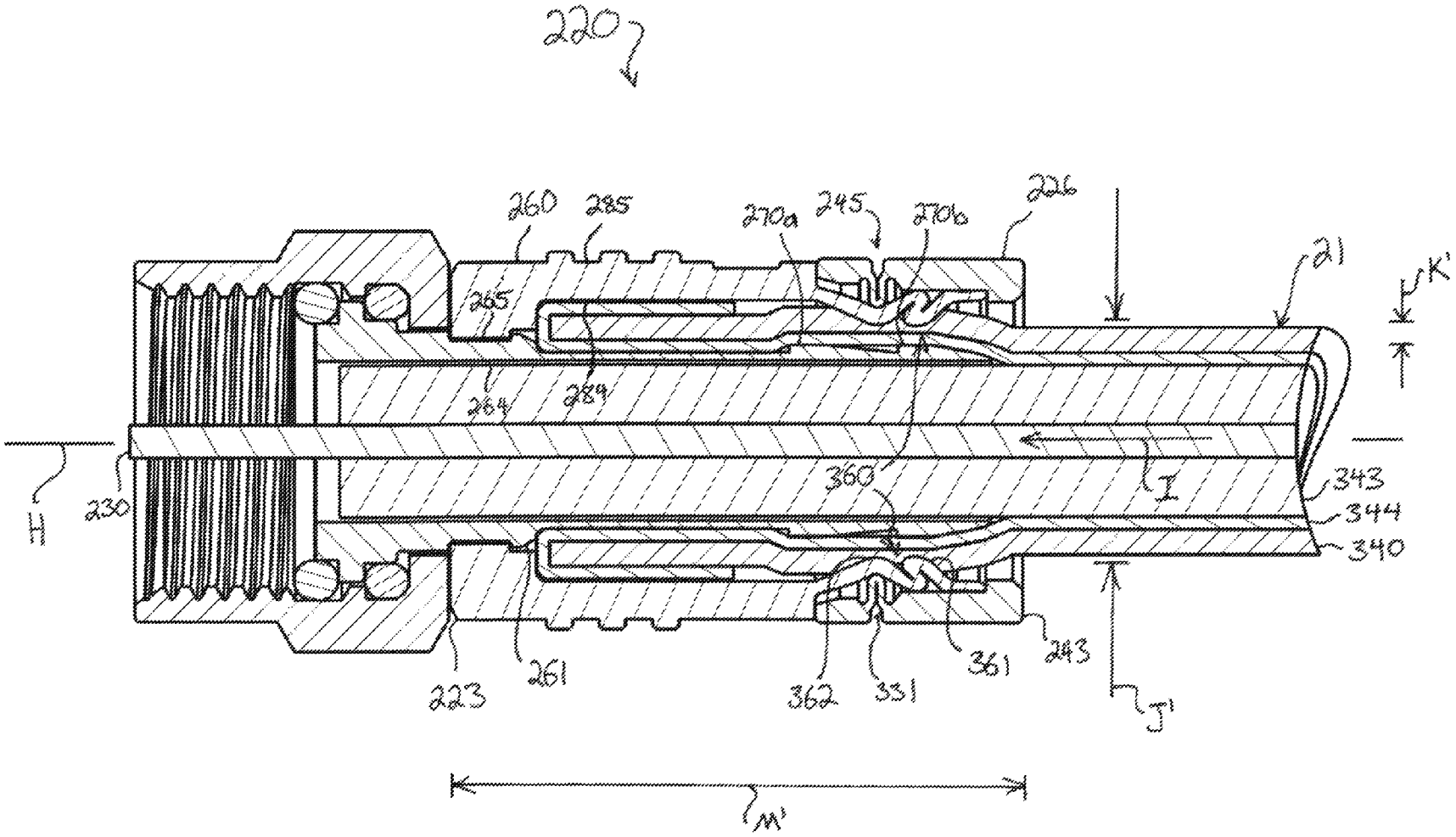

In operation, the cable connector 20 is useful for coupling a coaxial cable 21 to an electrical device in electrical communication, which is accomplished through a series of steps shown in FIGS. 8A-8C. Initially, the cable connector 220 is secured to the coaxial cable 21 as shown in FIG. 8A. The coaxial cable 21 is prepared to receive the cable connector 220 by stripping off a portion of a jacket 340 at an end 341 of the coaxial cable 21 to expose the inner conductor 230, a dielectric insulator 343, and a flexible shield 344. The dielectric insulator 343 is stripped back to expose a predetermined length of the inner conductor 230, and the end of the shield 344 is turned back to cover a portion of the jacket 340. The end 341 of the coaxial cable 21 is then introduced into the connector 220 to arrange the connector 220 in an uncompressed condition, as shown in FIG. 8A. In this condition, the inner post 261 is disposed between the shield 344 in electrical communication with the shield 344.

With reference still to FIG. 8A, to arrange the connector 220 into the uncompressed condition on the coaxial cable 21, the coaxial cable 21 is aligned with the axis H and passed into the interior space 252 of the compression collar 226 along a direction indicated by the arrowed line I. The coaxial cable 21 is then passed through the opening 291 and into the cable-receiving space 290 bound by the inner post 261, ensuring that the inner conductor is aligned with the axis H. The coaxial cable 21 continues to be moved forward along line I in FIG. 8A until the coaxial cable 21 encounters the rear end 263 of the inner post 261, where the shield 344 is advanced over the rear end 263 and the ridges 270*a* and 270*b* are placed in contact with the shield 344, and the portion of the shield 344 turned back over the jacket 340 is in contact with the inner surface 284 of the outer barrel 260. The dielectric insulator 343 is also advanced forward within the inner post 261 against the inner surface 264 of the inner post 261. Further forward movement of the coaxial cable 21 along line I advances the coaxial cable to the position illustrated in FIG. 8A, with the free end of the dielectric insulator 343 disposed within the nut portion 234 of the fitting 225 and the inner conductor 230 extending through the interior space 237 of the ring portion 233 and projecting beyond the opening 238 of the fitting 225. In this arrangement, the shield 344 is in contact in electrical communication with the outer surface 265 of the inner post 261.

With reference to FIGS. 7A and 8A, in the uncompressed condition of the connector 20, the outer barrel 60 has an inner diameter J, the inner surface 284 of the outer barrel 260 and the ridges 270*a* and 270*b* are separated by a distance K, and the length of the connector 220 between the front end 223 of the outer barrel 260 to the rear end 243 of the compression collar 226 is length M. In embodiments in which the connector 220 is to be used with RG6 style coaxial-cables, the inner diameter J is approximately 8.4 millimeters, the distance K is approximately 1.4 millimeters, and the length M is approximately 19.5 millimeters. Other embodiments, such as would be used with other types of cables, will have different dimensions.

From the uncompressed condition, the connector 220 is moved toward the compression condition illustrated in FIG. 8C by axially compressing the connector 220. The thin-walled outer and inner compression bands 245 and 246 of the outer barrel 260 and the compression collar 226, are useful for crimping down on the coaxial cable 21 to provide a secure, non-damaging engagement between the connector 220 and the coaxial cable 21 which prevents the cable 21 from being retracted from the connector 220. To compress the connector 220, the connector 220 is placed into a compressional tool which grips the connector 220 and compresses the connector 220 axially along the axis H from the front and rear ends 223 and 243.

The axial compressive forces along the axis H causes the compression collar 226 to move forward along the outer barrel 260 in the direction indicated by line I in FIG. 8B. The oblique first face 310 of the inner compression band 246 encounters the oblique face 333 of the outer compression band 245 and is diverted radially inwardly, causing the rear end 283 of the outer barrel 260 to collapse and deform radially inwardly. The first face 310 slides against the inner surface 251 of the compression collar 226, and the bend 305 deforms radially inwardly into the jacket 340, which causes the rounded hump portion 304 to deform inwardly as well. The bend 330 of the outer compression band 245 slides in contact with the rounded hump portion 304 as the compression collar 226 moves forward along the outer barrel 260.

The compression collar 226 stops advancing forward when the front end 242 reaches the shoulder 313 and contacts the abutment face 320. The abutment face 320 prevents further movement of the compression collar 226 along the outer barrel 260, but while the axial compression continues, the compression collar 226 compresses. The axial compressive forces along the axis H subject the thinned sidewalls 276 and 244 of the outer barrel 260 and the compression collar 226, respectively, to stress, urging each to deform and bend in response to the stress. The rear end 243 of the compression collar 326 is advanced toward the outer barrel 260, causing the compression collar 226 and outer barrel 260 to compress at the outer and inner compression bands 245 and 246, respectively.

The outer compression band 245, under continuing axial compressive forces, buckles into the V-shaped channel 314. The first and second wall portions 325 and 326 are obliquely oriented inwardly toward the axis H, so that the axial compressive force causes the first and second wall portions 325 and 326 to deform radially inward toward the axis H and come together. The bend 330 is forced radially inward into the rounded hump portion 304 to deform the inner compression band 246 radially inward as well. As the compression collar 226 compresses axially, the rear end 283 of the outer barrel 260 encounters the internal shoulder 334 at the rear end 243 of the compression collar 226 and is caught and held there. Continued compression, cooperating with the inward buckling of the outer compression band 245, causes the inner compression band 246 to buckle as well, as seen in FIG. 3B. The rear end 283 of the outer barrel 260 contacts and bears against the shoulder 334 of the compression collar 226, and the rear end 283 pivots inwardly at the shoulder 334, causing this buckling of the inner compression band 46 against the rounded hump portion 304.

Compression continues, and movement of the outer compression band 246 into the compressed condition thereof shapes the inner compression band 246 into a pawl 360, as shown in FIG. 3C. The pawl 360 is continuously annular and formed into the interior of the cable connector 220. The pawl 360 includes an annular folded lip 361 directed toward the front end of the outer barrel, and annular V-shaped channel 362 directed radially inward toward the axis H. The lip 361 overlies the channel 362. The outer compression band 245 is closed such that the compression space 331 is eliminated, and the connector 220 is placed in the compressed condition. Although the process of moving the connector 220 from the uncompressed condition to the compressed condition is presented and described above as a series of sequential steps, it should be understood that the compression of the connector 220 on the coaxial cable 21 is preferably accomplished in one smooth, continuous motion, taking less than one second.

In the compressed condition of the connector 220, the inner diameter J of the connector 220 is altered to an inner diameter J', the inner surface 284 of the outer barrel 260 and the barbs 270*a* and 270*b* are now separated by a distance K', and the length of the connector 220 between the front end 223 of the outer barrel 260 to the rear end 243 of the compression collar 226 is length M'. The distance K' is less than half the original distance K, the inner diameter J' is approximately the original inner diameter J less the distance K', and the length M' is less than the original length M. In embodiments in which the connector 220 is to be used with RG6 style coaxial-cables, the inner diameter J' is approximately 6.7 millimeters, the distance K' is approximately 0.5 millimeters, and the length M' is approximately 18.0 millimeters. Other embodiments, such as would be used with other types of cables, will have different dimensions. As seen in FIG. 8C, this significant reduction in diameter causes the jacket 340 and the shield 344 of the coaxial cable 21 to become engaged and crimped between the pawl 360 and the ridges 270*a* and 270*b* of the inner post 261.

Moreover, the pawl 360 is opposed from the ridges 270*a* and 270*b*, the channel 362 is disposed between the ridges 270*a* and 270*b*, and the lip 361 is behind the ridge 270*b*, toward the the rear end 243 of the outer barrel 260, so that the jacket 340 and shield 344 are crimped between the pawl 360 and the ridges 270*a* and 270*b* at an axial location between the ridges 270*a* and 270*b*, preventing withdrawal of the coaxial cable 21 from the connector 220. The pawl 360 allows movement of the cable 21 into the connector 220 along the direction indicated by arrowed line I in FIG. 8C, but prevents withdrawal of the cable 21 along a direction opposite to that of line I. When the cable 21 is attempted to be withdrawn, the pawl 360 deforms radially inwardly and further binds on the jacket 340, and the jacket 340 and shield 344 are compressively gripped between pawl 360 and the barbs 270*a* and 270*b*.

With continuing reference to FIG. 8C, the rigid material characteristics of the inner post 261 prevents the inner post 261 from being damaged by the crimping during application of the connector 220 on the cable 21. Furthermore, because the dielectric insulator 343 and inner conductor 230 are protected within the inner post 261 and the shield 344 is outside the inner post 261 in contact with the outer surface 265 of the inner post 261, the continuity of the connection between the shield 344 and the inner post 261 is maintained so that a signal transmitted through the connector 220 is not leaked outside of the connector 220, so that outside RF interference does not leak into the connector 220, and so that the connector 220 remains electrically grounded. The interaction between the shield 344 and the ridges 270*a* and 270*b*, which project forwardly and radially outward from axis H, further inhibit movement of the coaxial cable 21 rearwardly along a direction opposite to line I out of the connector 220, ensuring that the connector 220 is securely applied on the coaxial cable 21.

With the connector 20 in the compressed condition, the connector 20 can now be coupled to an electrical device in a common and well-known manner by threading the connector 20 onto a threaded post of a selected electrical device. The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A coaxial cable connector comprising:

an outer barrel including a longitudinal axis, the outer barrel formed with an inner compression band;

a coaxial fitting mounted at a front of the outer barrel for coupling to an electrical device;

a coaxial compression collar applied to the outer barrel;

an outer compression band, formed in the compression collar, which moves between an uncompressed condition and a compressed condition in response to axial compression of the coaxial cable connector; and movement of the outer compression band from the uncompressed condition to the compressed condition shapes the inner compression band into a pawl that allows introduction of a cable into the coaxial cable connector and then prevents removal of the cable therefrom.

2. The coaxial cable connector of claim 1, wherein the pawl comprises an annular folded lip formed in the inner compression band and directed toward the front of the outer barrel.

3. The coaxial cable connector of claim 1, wherein the pawl comprises an annular channel defined by a portion of the inner compression band deformed radially inwardly toward the longitudinal axis.

4. The coaxial cable connector of claim 3, wherein the pawl further comprises an annular folded lip formed in the inner compression band and directed toward the front of the outer barrel.

5. The coaxial cable connector of claim 4, wherein the folded lip overlies the channel.

6. The coaxial cable connector of claim 1, wherein:

the outer compression band includes opposed first and second wall portions and a bend formed between the first and second wall portions;

the inner compression band includes a ridge portion, a rounded hump portion, and a bend formed between the ridge and hump portions;

in the uncompressed condition, the first wall portion of the outer compression band is in contact with the ridge portion of the inner compression band, the second wall portion of the outer compression band is spaced radially apart from the rounded hump portion of the inner compression band, the bend of the outer compression band is in contact with the bend of the inner compression band, and a front end of the compression collar is mounted for sliding longitudinal contact along the rounded hump portion; and in the compressed condition, the first and second wall portions of the outer compression band are against each other and directed radially inwardly, the bend in the outer compression band urges the rounded hump portion of the inner compression band radially inwardly, and the ridge portion of the inner compression band is folded.

7. The coaxial cable connector of claim 5, wherein:

an inner post is carried within the outer barrel;

the inner post has spaced-apart annular first and second ridges; and in the compressed condition, the channel and the folded lip oppose the first and second ridges.

8. The coaxial cable connector of claim 7, wherein in the compressed condition:

the channel is disposed between the first and second ridges; and the folded lip is behind the first and second ridges.

9. A cable connector comprising:

an outer barrel configured to receive a cable;

a collar received on the outer barrel; and compressible compression bands formed in the outer barrel and the collar, the compressible compression band of the outer barrel including a shaped channel into which the compressible compression band of the collar is received, wherein the compressible compression band of the outer barrel is configured to provide a seal engagement with a cable received by the cable connector when the compressible compression band of the collar buckles into the channel of the compressible compression band of the outer barrel.

10. The cable connector of claim 9, wherein the compression bands are offset.

11. The cable connector of claim 9, wherein the compression bands comprise at least one pair of corresponding compressible compression bands.

12. The cable connector of claim 9, wherein the compression bands comprise a compressible first compression band formed in the outer barrel and a compressible second compression band formed in the collar.

13. The cable connector of claim 9, wherein the compression bands deform radially in response to axial compression of the connector, wherein the compression bands deforming radially comprises the compressible first and second compression bands each deforming radially.

14. The cable connector of claim 12, wherein:

the collar is outside the outer barrel; and the compressible second compression band is outside the compressible first compression band.

15. The cable connector of claim 12, wherein the compressible first and second compression bands are axially offset.

16. The cable connector of claim 12, wherein the compressible first and second compression bands each buckle in response to axial compression of the connector.

17. A cable connector comprising:

a body configured to receive a cable;

a collar configured to be received on the body; and flexible first and second compression bands in the body and collar, respectively, wherein the flexible first compression band includes a shaped channel into which flexible second compression band is received, and the flexible first compression band deforms radially in response to deformation of the flexible second compression band both in an axial direction and into the channel of the flexible first compression band.

18. The cable connector of claim 17, wherein the flexible second compression band deforms in the axial direction in response to compression of the connector in the axial direction.

19. The cable connector of claim 17, wherein the flexible second compression band is outside the flexible first compression band.

20. The cable connector of claim 17, wherein the flexible first and second compression bands are axially offset.

21. The cable connector of claim 17, wherein the flexible first and second compression bands each buckle in response to axial compression of the connector.

* * * * *